US008784067B2

(12) United States Patent
Iwano et al.

(10) Patent No.: US 8,784,067 B2
(45) Date of Patent: Jul. 22, 2014

(54) SCROLL TYPE BOOSTER

(75) Inventors: Kiminori Iwano, Yokohama (JP); Yuji Komai, Tokyo (JP); Susumu Sakamoto, Kawasaki (JP); Aya Mizukoshi, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 1384 days.

(21) Appl. No.: 12/155,153

(22) Filed: May 30, 2008

(65) Prior Publication Data

US 2008/0310966 A1 Dec. 18, 2008

(30) Foreign Application Priority Data

May 31, 2007 (JP) ..... 2007-145703

(51) Int. Cl.

| | |
|---|---|
| ***F04B 49/22*** | (2006.01) |
| ***F04C 2/02*** | (2006.01) |
| *F04B 49/02* | (2006.01) |
| *F04B 49/03* | (2006.01) |

(52) U.S. Cl.

CPC ..... *F04C 2/025* (2013.01); *F04B 49/022* (2013.01); *F04B 49/03* (2013.01)

USPC ..... 417/26; 417/19; 417/23; 417/295; 417/410.5

(58) Field of Classification Search

USPC ..... 417/19, 23, 44.2, 62, 244, 410.5, 295, 417/44.3, 26; 418/1, 55.3, 55.1; 137/565.3

See application file for complete search history.

(56) References Cited

U.S. PATENT DOCUMENTS

| | | | | |
|---|---|---|---|---|
| 1,511,468 A * | 10/1924 | Hill | 418/130 |
| 2,218,944 A * | 10/1940 | Wolfert | 62/209 |
| 2,989,000 A * | 6/1961 | Alcaro | 417/19 |
| 4,311,497 A * | 1/1982 | Newell | 62/158 |
| 5,538,396 A * | 7/1996 | Meierhoefer | 417/19 |
| 5,927,088 A * | 7/1999 | Shaw | 62/175 |

FOREIGN PATENT DOCUMENTS

| | | |
|---|---|---|
| JP | 63-179185 A | 7/1988 |
| JP | 2-218881 A | 8/1990 |
| JP | 2006-125336 A | 5/2006 |
| JP | 2007-051614 A | 3/2007 |
| WO | WO 2007134226 A1 * | 11/2007 |

OTHER PUBLICATIONS

JIII Journal of Technical Disclosure (*Kokai Giho*) 2006-504219, Japan Institute of Invention and Innovation (Jul. 31, 2006).

Japanese Office Action with partial English translation dated Jun. 5, 2012 (four (4) pages).

* cited by examiner

*Primary Examiner* — Charles Freay
*Assistant Examiner* — Christopher Bobish
(74) *Attorney, Agent, or Firm* — Crowell & Moring LLP

(57) ABSTRACT

An electromagnetic valve, which is provided between an intake port of a compressor body and a pneumatic line at an intermediate position of an intake pipe, is opened/closed by a control unit. Communication between the intake port of the compressor body and the pneumatic line is permitted when the valve is open, and is blocked when the valve is closed. In a start-up control of the compressor body, the electromagnetic valve is opened, permitting communication of the pneumatic line in the plant with the intake port of the compressor body for power supply to an electric motor to drive an orbiting scroll. Rattling of the orbiting scroll by an amount equal to the axial gap (play) is suppressed before starting a compression operation.

13 Claims, 13 Drawing Sheets

SCROLL TYPE BOOSTER

BACKGROUND OF THE INVENTION

1. Field of the Invention

The present invention relates to a scroll type booster connected to a pneumatic line in a plant, which is preferably employed as a booster for intensifying the pressure of a fluid such as air where appropriate.

2. Description of the Related Art

Generally in a plant where a plurality of pneumatic apparatuses are installed, the apparatuses are connected with one another using a pneumatic line (piping) such that compressed air discharged from an air compressor serving as a compressed air source is supplied to the respective pneumatic apparatuses via the pneumatic line. The air pressure within the line at the downstream side is boosted using a reciprocating compressor, a so-called booster type compressor, as disclosed in Japanese Unexamined Patent Application Publication No. 2007-51614.

The aforementioned reciprocating compressor allows a piston to move reciprocally inside a cylinder to discharge intake air compressed therein. The compressor is likely to be a source of noise as the operation sound resulting from the discharge of air is loud, thus deteriorating the peripheral work environment.

In contrast, a scroll type fluid machine, known as a noiseless compressor, has a lower operation sound volume than the reciprocating compressor. With a scroll type compressor, an orbiting scroll is driven by a drive unit such as an electric motor to turn with respect to a fixed scroll such that the fluid such as air may be continuously compressed within a compressor chamber arranged between the scrolls as disclosed in Kokai-Giho (Journal of technical disclosure) No. 2006-504219.

The scroll type compressor as described above includes a magnet between the opposing surfaces of the fixed scroll and the orbiting scroll. The magnetic force of the magnet is used to restrain the displacement of the orbiting scroll before starting the compression operation, for example, minimize rattle or vibration of the orbiting scroll by an amount equal to the axial gap (play).

As the aforementioned magnet, the use of an electromagnet such as a solenoid has been proposed. When such an electromagnet is employed, the power supply to the electromagnet is stopped when required, for example, at the start-up of the compression operation to stop generation of the magnetic force to allow the orbiting scroll to be more smoothly moved (orbiting movement).

In the structure disclosed in Kokai-Giho (Journal of technical disclosure) No. 2006-504219, the magnetic force of the magnet serves to restrain rattle or vibration of the orbiting scroll in the axial direction under the action of the external force before starting the compression operation.

In order to obtain sufficient restraining force from the magnetic force of the magnet, the magnet is required to be large enough to support the weight of the orbiting scroll. The resultant magnet, thus, becomes expensive. The use of a structure of this type is not necessarily an effective solution in terms of cost-effectiveness.

When the magnetic force of the magnet acts upon the orbiting scroll during the compression operation (steady operation), the resistance against the driving operation of the orbiting scroll to orbit is generated to adversely influence the magnetic force. This may increase the start-up load, the mechanical loss, and finally, deteriorate the operation efficiency.

Meanwhile, when an electromagnet such as a solenoid is employed, power supply is stopped upon starting of the compression operation to stop generation of the magnetic force to compensate for the smooth movement of the orbiting scroll. In this case, however, an electromagnet which is large and expensive is required. The use of its structure, thus, is not necessarily a realistic solution in terms of cost-effectiveness.

In the aforementioned case, the electric wiring for power supply to the electromagnet is required to be installed at the fixed scroll, which makes the structure of the scroll type compressor complicated. It is therefore difficult to realize a compact and lightweight structure.

SUMMARY OF THE INVENTION

Accordingly, it is an object of the present invention to provide a scroll type booster which ensures a noiseless structure by reducing operation sound using a scroll type compressor as a booster and an easy start-up operation.

A scroll type booster according to the present invention includes a scroll type compression unit which sucks a pressurized fluid supplied from an external pressurized fluid supply unit through an intake port, compresses the pressurized fluid in a compressor chamber, and discharges a compressed fluid from a discharge port during an orbiting movement with wrap portions of two scroll members overlapped, a drive unit for driving at least one of the scroll members which form the compression unit for the orbiting movement, an on-off valve disposed between the intake port of the compression unit and the pressurized fluid supply unit for allowing and blocking a communication between the intake port and the pressurized fluid supply unit, and a control unit for controlling opening and closing of the on-off valve, and driving and stopping of the drive unit. The control unit allows the drive unit to drive the scroll member for the orbiting movement after allowing the pressurized fluid supply unit to communicate with the intake port via the scroll member.

The compression unit includes an anti-spinning mechanism for suppressing a spinning of the scroll member to be driven for the orbiting movement. The anti-spinning mechanism may be formed of a ball coupling which includes a rigid spherical ball, and a pair of thrust bearings which grip the ball from both sides of the scroll member in a thrust direction to bear a thrust load exerted on at least one of the scroll member.

The control unit may be structured to start driving the drive unit in a period after opening the on-off valve and before a pressure of the discharge port of the compression unit becomes equal to a pressure of the intake port.

A pressure sensor is disposed at a discharge side of the compression unit. The control unit may be structured to start driving the drive unit in a period after opening the on-off valve and before a pressure value detected by the pressure sensor reaches a supply pressure value of the pressurized fluid supply unit.

A discharge pressure sensor is disposed at a discharge side of the compression unit. An intake pressure sensor is disposed at an intake side of the compression unit. The control unit may be structured to start driving the drive unit after opening the on-off valve and when a difference between a pressure value detected by the discharge pressure sensor at the discharge side and a pressure value detected by the intake pressure sensor at the intake side becomes equal to or smaller than a predetermined differential pressure.

A pressure sensor is disposed at a discharge side of the compression unit. The control unit may be structured to keep the drive unit stopped until a pressure value detected by the pressure sensor at the discharge side reaches a preliminarily set pressure value, and to drive the drive unit when the pressure value exceeds the preliminarily set pressure value.

The drive unit is provided with a rotary sensor for detecting a rotation position. The control unit may be structured to drive the drive unit when a position detected by the rotary sensor exceeds a predetermined rotation position after opening the on-off valve.

The control unit may be structured to drive the drive unit in a predetermined time range after opening the on-off valve.

A release valve is disposed between the intake port of the compression unit and the pressurized fluid supply unit for opening the intake port to atmosphere while the on-off valve is closed. The control unit may be structured to stop an operation of the drive unit to open the release valve while the on-off valve is closed.

According to an embodiment of the present invention, when the pressurized fluid supply unit is communicated with the intake port by operating the on-off valve before starting the compression operation by the compression unit, the pressurized fluid from the pressurized fluid supply unit is allowed to flow into the compressor chamber through the intake port of the compression unit. The resultant fluid pressure allows easy start-up operation.

According to another embodiment, as the anti-spinning mechanism of the scroll member to be driven to orbit is formed of a ball coupling, the thrust load applied from the compressed fluid to the scroll member may be borne by a pair of thrust bearings which grip the spherical ball from both sides of the scroll member in the thrust direction (axial directions) of the scroll member. This makes it possible to suppress unstable behavior of the scroll member, and to allow the smooth prevention of the spinning of the scroll member, thus stabilizing the orbiting movement. The fluid pressure from the pressurized fluid supply unit is capable of easily suppressing the rattle in the ball coupling before starting the compression operation.

According to another embodiment, the operation for driving the drive unit is started for a certain period until the pressure of the discharge port of the compression unit becomes equal to that of the intake port after opening the on-off valve. The pressurized fluid flowing into the compressor chamber from the pressurized fluid supply unit via the intake port of the compression unit further flows from the compressor chamber at the outer diameter side toward the compressor chamber at the inner diameter side so as to be gradually infiltrated. The resultant fluid pressure serves to press the scroll member to be driven to orbit in the axial direction, and to slowly orbit the scroll member. In the aforementioned state for a certain period until the pressure of the discharge port of the compression unit is equal to that of the intake port, the drive unit starts driving the scroll member to orbit so as to smoothly drive the scroll member to orbit, thus easily reducing the start-up load and the like exerted on the drive unit.

According to another embodiment, the drive unit is driven for a certain period until the pressure value detected by the pressure sensor at the discharge side reaches the supply pressure value of the pressurized fluid supply unit after opening the on-off valve. In accordance with the preliminarily obtained supply pressure value of the pressurized fluid supply unit and the pressure value detected by the pressure sensor at the discharge side, the timing for driving the drive unit (timing for starting the compression operation) may be appropriately controlled.

According to another embodiment, when the difference of the detected pressure value between the pressure sensor at the discharge side and the pressure sensor at the intake side is equal to or lower than the predetermined differential pressure after opening the on-off valve, the structure starts driving the drive unit. In accordance with the pressure values detected by the pressure sensors at the intake and discharge sides, the timing for driving the drive unit (timing for starting the compression operation) may be appropriately controlled.

According to another embodiment, the drive unit is stopped until the pressure value detected by the pressure sensor at the discharge side reaches the preliminarily set pressure value after opening the on-off valve, and the drive unit is driven when the detected pressure value exceeds the set pressure value. In accordance with the preliminarily set pressure value and the pressure value detected by the pressure sensor at the discharge side, the timing for driving the drive unit (timing for starting the compression operation) may be appropriately controlled.

According to another embodiment, the rotary sensor is provided for detecting the rotation position of the drive unit. The control unit is structured to start driving the drive unit when the detected position of the rotary sensor exceeds the preliminarily set rotation position after opening the on-off valve. In accordance with the rotation of the shaft of the drive unit corresponding to the angle after opening the on-off valve, the timing for driving the drive unit (timing for starting the compression operation) may be appropriately controlled.

According to another embodiment, it is structured to start driving the drive unit within a predetermined time range after opening the on-off valve. The appropriate timing for starting the drive of the drive unit is obtained based on the experimental data so as to reduce the start-up load when starting the compression operation.

According to another embodiment, a release valve for opening the intake port side to the atmosphere while keeping the on-off valve closed is provided between the intake port of the compression unit and the pressurized fluid supply unit. Even if the compressed fluid resides in the compressor chambers immediately after stopping the compression operation performed by the scroll type compression unit, the release valve may be opened such that the pressure within the compressor chamber is released into the atmosphere from the intake port by stopping the drive unit to close the on-off valve (the communication between the intake port of the compression unit and the pressurized fluid supply unit is blocked). This makes it possible to suppress generation of the drain inside the compressor chamber.

DESCRIPTION OF THE PREFERRED EMBODIMENTS

Figure 1:
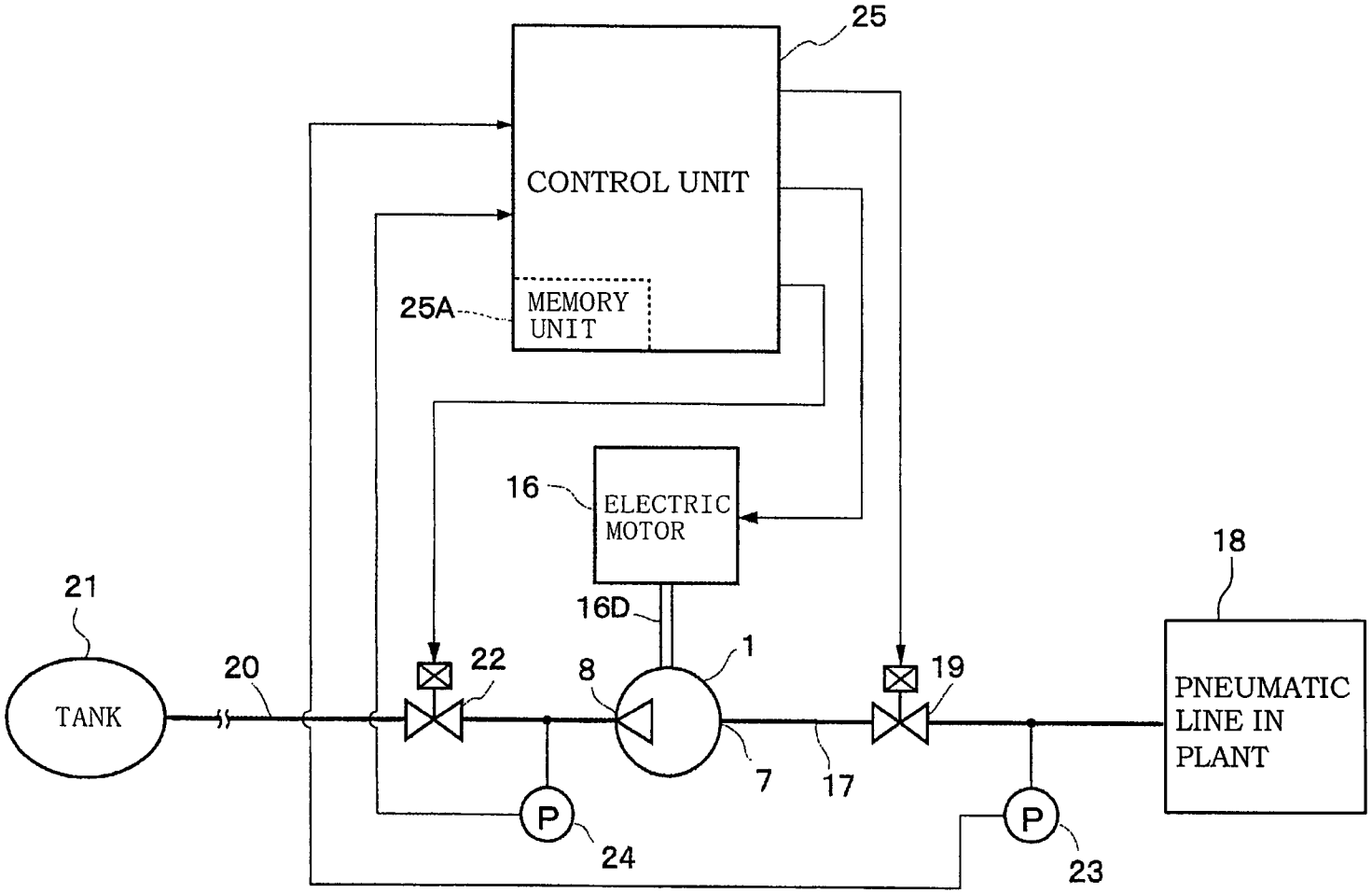
FIG. 1 is a view schematically showing a scroll type booster according to a first embodiment of the present invention.

A scroll type booster according to embodiments of the present invention will be described in the form of a booster or a booster machine employed for a pneumatic line in a plant with reference to the drawings.

In a first embodiment shown in FIGS. 1 to 3, a scroll type compressor body 1 forms a compression unit of the scroll type (hereinafter referred to as a compressor body). FIG. 2 shows a casing 2 having a bottomed cylindrical body having one side in the axial direction opened forms an outer shell of the compressor body 1. An electric motor 16 provided with a drive shaft 16D on the axial line 01-01 is detachably installed in the other side of the casing 2 in the axial direction.

In the aforementioned case, the casing 2 is mainly formed of a cylinder portion 2A having an open side in the axial direction (at the side of a fixed scroll 3 to be described later), an annular bottom portion 2B integrated to the other side of the cylinder portion 2A in the axial direction to radially extend inward, and a cylindrical bearing installation portion 2C which extends from the inner circumferential side of the bottom portion 2B toward one side in the axial direction. The cylinder portion 2A of the casing 2 stores an orbiting scroll 5, an eccentric bush 12, a balance weight 13, an anti-spinning mechanism 15 and the like which will be described later.

The bottom portion 2B of the casing 2 is provided with a plurality of bases 2D (only one base is shown in FIG. 2) which bear the thrust load in the axial direction exerted on the orbiting scroll 5 (later described). The bases 2D are arranged in the circumferential direction of the casing 2 at predetermined intervals.

A fixed scroll 3 fixed to the open end side of the casing 2 (cylinder portion 2A) is mainly formed of a mirror plate 3A with a circular disk-like shape around the axial line 01-01 shown in FIG. 2, a spiral wrap portion 3B which stands on the surface of the mirror plate 3A, and a cylindrical support portion 3C which is disposed on the outer circumferential side of the mirror plate 3A to surround the wrap portion 3B on the outer diameter side, and is fixed to the open end side of the casing 2 (cylinder portion 2A) with a plurality of bolts 4.

The orbiting scroll 5 is installed at a position opposite the fixed scroll 3 in the axial direction in the casing 2 so that it can orbit. The orbiting scroll 5 is mainly formed of a circular disk-like mirror plate 5A having the axial line 02-02 shown in FIG. 2 as the center thereof, a spiral wrap portion 5B which stands on the surface of the mirror plate 5A, and a cylindrical boss portion 5C installed in the eccentric bush 12 to be described later via a slewing bearing 14 to protrude at the back surface (surface opposite the wrap portion 5B) of the mirror plate 5A.

A plurality of installation seats 5D (only one seat is shown in FIG. 2) into which the thrust bearing 15B of the anti-spinning mechanism 15 to be described later is fitted and installed are provided in the circumferential direction of the orbiting scroll 5 at intervals in the outer diameter side of the back surface of the orbiting scroll 5. The installation seats 5D are provided at positions opposite the bases 2D of the casing 2 in the axial direction.

The boss portion 5C of the orbiting scroll 5 is disposed such that the axial line 02-02 as the center thereof is radially eccentric with respect to the axial line 01-01 as the center of the fixed scroll 3 by an amount corresponding to the predetermined dimension 6 by means of the eccentric bush 12 to be described later. In the aforementioned state, the wrap portion 5B of the orbiting scroll 5 is disposed to be overlapped with the wrap portion 3B of the fixed scroll 3 such that a plurality of compressor chambers 6, 6, . . . are defined by the respective wrap portions 3B and 5B.

The orbiting scroll 5 is driven by the electric motor 16 via the rotary shaft 9 and the eccentric bush 12, and orbits with respect to the fixed scroll 3 in the state where spinning is restrained by the anti-spinning mechanism 15 to be described later. The orbiting scroll 5 orbits with respect to the axial line 01-01 of the fixed scroll 3 with the orbiting radius corresponding to the dimension δ.

Among the plural compressor chambers 6, the one at the outer diameter side sucks air from an intake port 7 disposed at the outer circumference of the fixed scroll 3. The sucked air is then continuously compressed accompanied with the orbiting movement of the orbiting scroll 5 within the respective compressor chambers 6. The compressor chamber 6 at the inner diameter side discharges the compressed air to the outside from a discharge port 8 disposed at the center of the fixed scroll 3.

A rotary shaft 9 is rotatably provided in the bearing installation portion 2C of the casing 2 via a bearing 10. The rotary shaft 9 has its proximal end (one end in the axial direction) detachably fixed to the drive shaft 16D of the electric motor 16 to be described later so as to be driven to rotate by the electric motor 16. The boss portion 5C of the orbiting scroll 5 is orbitably connected to the leading end of the rotary shaft 9 (the other end in the axial direction) via the eccentric bush 12 and the slewing bearing 14 to be described later.

A sub-weight 11 which extends radially outward as shown in FIG. 2 is integrated with the proximal end of the rotary shaft 9. The sub-weight 11 serves to negate the external force (moment force) in the direction in which the rotary shaft 9 is tilted by the centrifugal force generated upon the respective rotations of the balance weight 13 and the orbiting scroll 5.

The eccentric bush 12 with a stepped cylindrical shape is disposed at the leading end of the rotary shaft 9 for connecting the boss portion 5C of the orbiting scroll 5 to the rotary shaft 9 via the slewing bearing 14 to be described later in the eccentric state. The eccentric bush 12 is rotated together with the rotary shaft 9, and converts the rotation into the orbiting movement of the orbiting scroll 5. The balance weight 13 for stabilizing the orbiting movement of the orbiting scroll 5 is integrally formed at the outer circumference of the eccentric bush 12.

The slewing bearing 14 disposed between the boss portion 5C of the orbiting scroll 5 and the eccentric bush 12 orbitably supports the boss portion 5C of the orbiting scroll 5 with respect to the eccentric bush 12 so as to compensate for the orbiting movement of the orbiting scroll 5 with respect to the axial line 01-01 of the rotary shaft 9 with the orbiting radius (dimension δ).

Each of the anti-spinning mechanisms 15 (for example, three mechanisms) disposed between the bottom portion 2B of the casing 2 and the back surface of the orbiting scroll 5 is formed of so-called ball coupling. The anti-spinning mechanisms 15 are operated to prevent the spinning of the orbiting scroll 5 via thrust bearings 15A and 15B, and a ball 15C to be described later. The anti-spinning mechanisms 15 are disposed between the respective bases 2D of the casing 2 and the respective installation seats 5D of the orbiting scroll 5.

Each of the anti-spinning mechanisms 15 formed of the ball coupling includes the first thrust bearing 15A fixed to the base 2D of the casing 2 as shown in FIG. 2, the second thrust bearing 15B disposed at the installation seat 5D of the orbiting scroll 5 opposite the first thrust bearing 15A in the axial direction, and the spherical ball 15C allowed to roll between the first and the second thrust bearings 15A and 15B.

The ball 15C of the anti-spinning mechanism 15 has a spherical shape formed of a material with high rigidity such as a steel ball, and bears the thrust load exerted on the mirror plate 5A of the orbiting scroll 5 at the base portion 2D of the casing 2 together with the thrust bearings 15A and 15B. The anti-spinning mechanism 15 formed of the ball coupling also serves as the thrust support mechanism.

The electric motor 16 as the drive unit for driving the orbiting scroll 5 to orbit includes a motor case 16A as the outer shell. The motor case 16A is fixed to the casing 2 of the compressor body 1 so as to be integrated at the bottom portion 2B as shown in FIG. 2. The electric motor 16 is mainly formed of a stator 16B fixed to the inner circumference of the motor case 16A, a rotor 16C rotatably disposed inside in the radial direction of the stator 16B, and a drive shaft 16D which is provided at the center of the rotor 16C to rotate integrally therewith.

The drive shaft 16D of the electric motor 16 has the leading end (one side in the axial direction) extending toward the bottom portion 2B of the casing 2, and is integrally connected to the rotary shaft 9 as shown in FIG. 2. When power is externally supplied to the electric motor 16 by the control unit 25 to be described later, the drive shaft 16D is driven to rotate around the axial line 01-01 shown in FIG. 2 such that the orbiting scroll 5 is driven to orbit via the rotary shaft 9, the eccentric bush 12 and the like.

Figure 2:
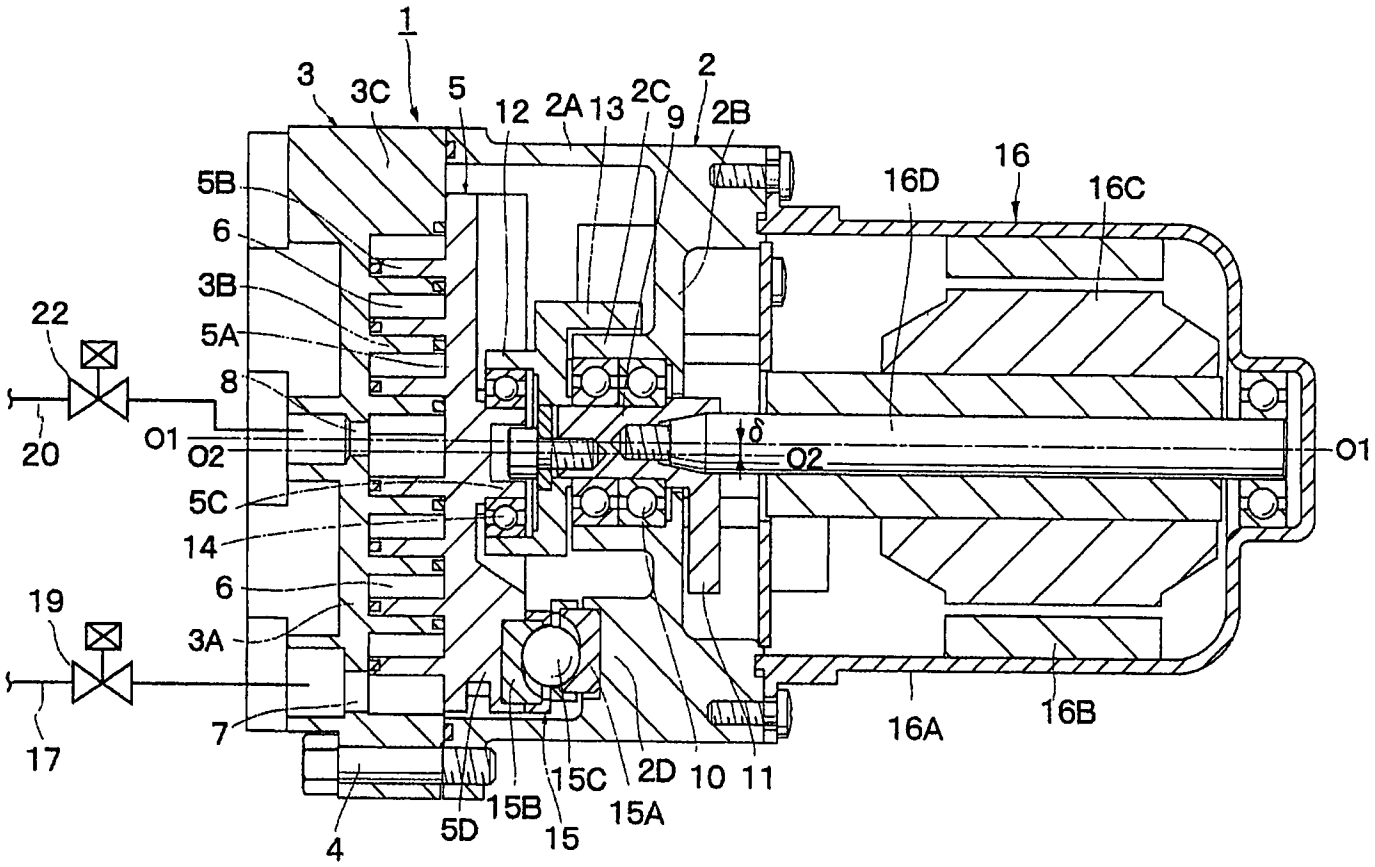
FIG. 2 is a vertical sectional view of an enlarged body of the scroll type compressor shown in FIG. 1.

An intake pipe 17 connected to the intake port 7 of the compressor body 1 is connected to a pneumatic line 18 in the plant as shown in FIG. 1. The pneumatic line 18 forms a pressurized fluid supply unit for supplying the pressurized air at a pressure in the range from 0.1 to 0.5 MPa (Megapascals). Specifically, in the plant where various pneumatic apparatuses (not shown) are installed, the pneumatic line 18 (pipe) for connecting the respective pneumatic apparatuses is provided such that the pneumatic apparatus is operated under the pressurized air when needed.

The air pressure in the pneumatic line 18 is set to 0.5 MPa or lower, for example. If compressed air at a pressure higher than the aforementioned value is required, the intake port 7 of the compressor body 1 is connected to the pneumatic line 18 via the intake pipe 17 such that the compressor body 1 of scroll type is used as the booster or booster machine as shown in FIG. 1 to generate high pressure compressed air in the tank 21 to be described later. The high pressure compressed air within the tank 21 is appropriately fed to the pneumatic apparatus requiring the high-pressure specification.

An electromagnetic valve 19 as an on-off valve disposed between the intake port 7 of the compressor body 1 and the pneumatic line 18 is connected to an intermediate portion of the intake pipe 17 or the open end of the intake port 7. The electromagnetic valve 19 is controlled to be opened and closed by the control unit 25 to be described later. When it is opened, the intake port 7 of the compressor body 1 communicates with the pneumatic line 18. When it is closed, the communication between the intake port 7 and the pneumatic line 18 is blocked.

A discharge pipe 20 for connecting the discharge port 8 to the tank 21 at the downstream side supplies the compressed air to the pneumatic apparatus requiring the high pressure specification while allowing the tank 21 to store the high pressure compressed air discharged from the discharge port 8 of the compressor body 1.

An electromagnetic valve 22 as an on-off valve at the discharge side disposed between the discharge port 8 of the compressor body 1 and the tank 21 is connected to the intermediate portion of the discharge pipe 20 or the open end of the discharge port 8. The electromagnetic valve 22 is controlled to be opened and closed by the control unit 25 to be described later. When it is opened, the discharge port 8 of the compressor body 1 communicates with the tank 21. When it is closed, the communication between the discharge port 8 and the outside is kept blocked.

A pressure sensor 23 for detecting the pressure at the intake side is disposed at the intermediate portion of the intake pipe 17 between the electromagnetic valve 19 at the intake side and the pneumatic line 18. The pressure sensor 23 detects the air pressure within the pneumatic line 18 upstream of the electromagnetic valve 19 as the pressure Pi (see FIG. 3) irrespective of its open/closed state. The resultant detection signal is output to the control unit 25.

Another pressure sensor 24 for detecting the pressure at the discharge side is disposed at the intermediate portion of the discharge pipe 20 between the discharge port 8 of the compressor body 1 and the electromagnetic valve 22 at the discharge side. The pressure sensor 24 detects the pressure $P_0$ of the discharge port 8 (see FIG. 3), and the resultant detection signal is output to the control unit 25.

The control unit 25 formed of the microcomputer has the input side connected to the pressure sensors 23 and 24, and the output side connected to the electric motor 16 and the electromagnetic valves 19 and 22. The control unit 25 includes a memory unit 25A formed of a ROM and a RAM for storing the processing program shown in FIG. 3 to be described later, and the reference pressure $\alpha$ ($\alpha$: differential pressure ranging from 0.01 to 0.1 MPa) as the reference value for starting the electric motor 16.

Figure 3:
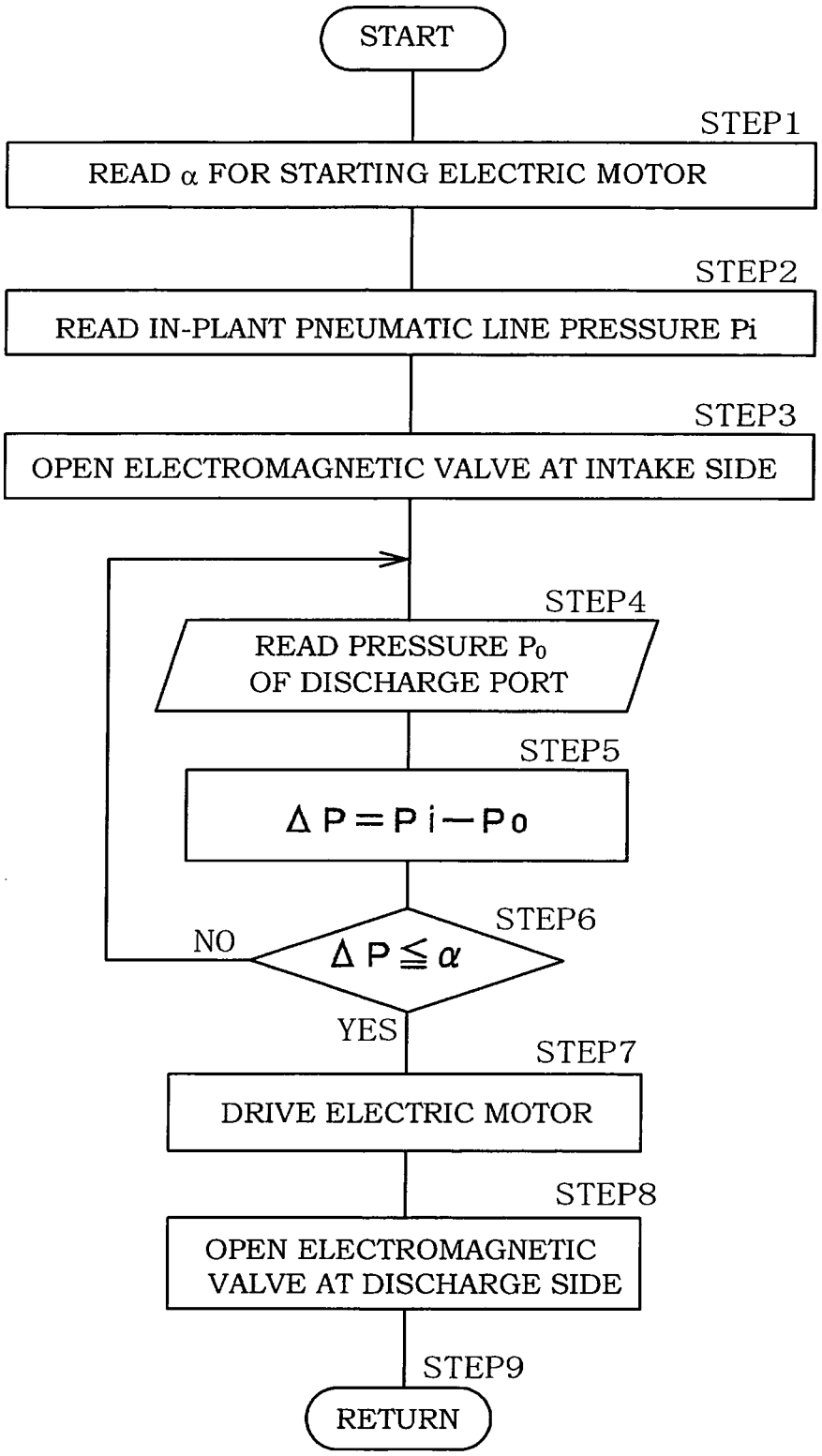
FIG. 3 is a flowchart showing the start-up control process performed by a control unit before the compression operation.

The control unit 25 executes the start-up control process with respect to the compressor body 1 according to the program shown in FIG. 3, and further executes the operation control of the compressor body 1 such that the pressure within the tank 21 shown in FIG. 1 becomes the pressure value (not shown) in a predetermined range. Then the electromagnetic valves 19 and 22 are subjected to the on-off control, and the electric motor 16 is controlled to be driven and stopped in accordance with the aforementioned execution.

The operation of the thus structured scroll type booster will be described hereinafter.

In the compressor body 1 shown in FIG. 2, when power is supplied to the electric motor 16 from the control unit 25 (see FIG. 1) to rotate the drive shaft 16D, the rotary shaft 9 and the eccentric bush 12 are driven to rotate around the axial line 01-01 as the center. The orbiting scroll 5 is operated to orbit with the predetermined orbiting radius (dimension 6 shown in FIG. 2) in the state where spinning is restrained by three of the anti-spinning mechanisms 15.

Then the respective compressor chambers 6 defined by the wrap portions 3B of the fixed scroll 3 and the wrap portions 5B of the orbiting scroll 5 are continuously reduced from the outer diameter side toward the inner diameter side. Among those compressor chambers 6, the one at the outer diameter side sucks air (pressurized air from the pneumatic line 18) from the intake port 7 at the outer circumference of the fixed scroll 3. The air is then continuously compressed to boost the pressure inside the compressor chambers 6 while discharging the high-pressure compressed air toward the discharge pipe 20 via the discharge port 8 from the compressor chambers 6 at the inner diameter side.

Under the compression operation, the pressure of air compressed in the respective compressor chambers 6 acts on the mirror plate 5A of the orbiting scroll 5 as the thrust load. However, the three anti-spinning mechanisms 15, so-called ball couplings, are disposed between the base 2D of the casing 2 and the back surface (installation seat 5D) of the orbiting scroll 5.

As each of the anti-spinning mechanisms 15 includes the first and the second thrust bearings 15A and 15B, and the ball 15C, the thrust load exerted on the mirror plate 5A of the orbiting scroll 5 may be borne by the first and the second thrust bearings 15A and 15B, and the ball 15C of the anti-spinning mechanism 15. This makes it possible to prevent the orbiting scroll 5 from being displaced in the axial direction of the casing 2, and tilting diagonally toward the fixed scroll 3, thus stabilizing the orbiting movement of the orbiting scroll 5.

The fixed scroll 3 and the orbiting scroll 5 are provided such that a gap (play) in the axial direction is preliminarily formed between the opposing mirror plates 5A and 3A for accommodating the thermally expanded wrap portions 3B and 5B under the compression heat. In the state where the wrap portions 3B and 5B are not thermally expanded before starting the compression operation, the gap (play) in the axial direction is likely to cause rattle or vibration of the orbiting scroll 5, resulting in unstable behavior thereof.

Especially when the anti-spinning mechanism 15 of the orbiting scroll 5 is formed of a ball coupling, the spherical ball 15C is merely interposed between the two thrust bearings 15A and 15B. The orbiting scroll 5 is likely to be displaced by an amount equal to the gap (play) in the axial direction before starting the compression operation, which may cause the behavior of the orbiting scroll 5 to be unstable.

In the embodiment, the control unit 25 executes the start-up control process as shown in FIG. 3 to stabilize the behavior of the orbiting scroll 5 as well as reduce the start-up load when starting the compression operation.

Referring to the flowchart shown in FIG. 3, when the process starts, a reference pressure $\alpha$ (for example, the differential pressure $\alpha$ in the range from 0.01 to 0.1 MPa) as the reference value for starting the electric motor 16 is read from the memory unit 25A in step 1. In step 2, the air pressure within the pneumatic line 18 is read from the pressure sensor 23 as the pressure value Pi.

Then in step 3, the electromagnetic valve 19 at the intake side is opened to communicate the intake port 7 of the compressor body 1 with the pneumatic line 18 such that the air pressure within the pneumatic line 18 (pressurized air) is allowed to flow into the compressor chamber 6 from the intake port 7 of the compressor body 1 via the intake pipe 17.

In step 4, the pressure $P_0$ of the discharge port 8 is read from the pressure sensor 24 at the discharge side of the compressor body 1. Then in step 5, a differential pressure $\Delta P$ between the pressure Pi within the pneumatic line 18 and the pressure $P_0$ of the discharge port 8 is calculated using the following formula 1.

$$\Delta P = Pi - P_0 \qquad \text{Formula 1}$$

In step 6, it is determined whether or not the differential pressure $\Delta P$ is equal to or lower than the reference pressure $\alpha$ (for example, $\alpha$=0.01 to 0.1 MPa). When NO is obtained, the process returns to step 4 and subsequent steps are executed. When YES is obtained in step 6, the differential pressure $\Delta P$ is equal to or lower than the reference pressure $\alpha$, and the pressure $P_0$ of the discharge port 8 is close to a value substantially the same as the pressure Pi within the pneumatic line 18.

When the electromagnetic valve 19 at the intake side is opened in step 3, the pressurized air within the pneumatic line 18 flows into the compressor chamber 6 from the intake port 7 of the compressor body 1 via the intake pipe 17. The air pressure at this time is exerted on the mirror plate 5A of the orbiting scroll 5 as the thrust load. The thrust load may be borne by the first and the second thrust bearings 15A and 15B and the ball 15C of the anti-spinning mechanism 15. This makes it possible to suppress the displacement of the orbiting scroll 5 in the axial direction of the casing 2, and the diagonal tilt toward the fixed scroll 3 to stabilize the orbiting movement of the orbiting scroll 5.

As a result, when the wrap portions 3B and 5B are not thermally expanded before starting the compression operation, the pressurized air within the pneumatic line 18 is allowed to flow into the compressor chamber 6 from the intake port 7 of the compressor body 1 so as to restrain rattle or vibration of the orbiting scroll 5 by an amount equal to the axial gap (play). Unstable behavior of the orbiting scroll 5, thus, may be suppressed.

The pressurized air flowing from the intake port 7 of the compressor body 1 into the compressor chamber 6 acts on the wrap portion 5B of the orbiting scroll 5 in the compressor chamber 6 at the outer diameter side, and the air pressure acts as the drive pressure toward the direction for orbiting the orbiting scroll 5 slowly.

When YES is obtained in step 6, the process proceeds to step 7 where the power is supplied to the electric motor 16 so as to be driven, and the rotary shaft 9 and the eccentric bush 12 are driven to rotate by the drive shaft 16D so as to start driving the orbiting scroll 5 to orbit with the predetermined orbiting radius (dimension 6 shown in FIG. 2). Then in step 8, the electromagnetic valve 22 at the discharge side is opened. The process returns to step 9 to continue the compression operation (steady operation).

The respective compressor chambers 6 defined by the wrap portions 3B of the fixed scroll 3 and the wrap portions 5B of the orbiting scroll 5 are sequentially reduced from the outer diameter side to the inner diameter side. The air sucked through the intake port 7 (pressurized air from the pneumatic line 18) is sequentially compressed for boosting the pressure in the compressor chamber 6, and then the high pressure compressed air may be discharged to the tank 21 from the compressor chambers 6 at the inner diameter side via the discharge port 8 and the discharge pipe 20.

In the embodiment, the start-up control process is executed by the control unit 25 to open the electromagnetic valve 19 at the intake side so that the pneumatic line 18 in the plant communicates with the intake port 7 of the compressor body 1, and then the power is supplied to the electric motor 16 to drive the orbiting scroll 5 for the orbiting movement.

Prior to the start-up of the compressor body 1, the pressurized air from the pneumatic line 18 is allowed to flow into the compressor chamber 6 from the intake port 7 of the compressor body 1. The resultant air pressure allows easy start-up of the orbiting scroll 5. In this case, the pressurized air (fluid pressure) flowing from the intake port 7 of the compressor body 1 into the compressor chamber 6 acts to exert the force in the orbiting (rotating) direction on the orbiting scroll 5 (the scroll member expected to orbit), thus reducing the start-up load.

The pressurized air flowing into the compressor chamber 6 from the intake port 7 of the compressor body 1 acts as the drive pressure to slowly orbit the orbiting scroll 5. The orbiting scroll 5 is driven to orbit by the electric motor 16 in the aforementioned state to allow smooth start-up of the orbiting scroll 5. As a result, the start-up load of the electric motor 16 may be easily reduced.

Before starting the compressor body 1, the pressurized air from the pneumatic line 18 is allowed to flow into the compressor chamber 6 from the intake port 7 of the compressor body 1 so as to press the orbiting scroll 5 to be driven under the air pressure in the axial direction. As a result, rattle or vibration of the orbiting scroll 5 by an amount equal to the axial gap (play) before starting the compression operation may be restrained by the pressurized air form the pneumatic line 18, thus stabilizing the behavior of the orbiting scroll 5.

As the pressurized air flowing into the compressor chamber 6 may press the orbiting scroll 5 in the axial direction, the resultant air pressure prevents the orbiting scroll 5 from rattling or vibrating in the axial direction. So the behavior of the anti-spinning mechanism 15 (thrust bearings 15A and 15B, and the ball 15C) serving as the thrust support mechanism may be stabilized before the start-up. This makes it possible to smoothly start the orbiting scroll 5 by the electric motor 16.

In the embodiment, as the anti-spinning mechanism 15 of the orbiting scroll 5 is formed of the ball coupling, the thrust load exerted on the orbiting scroll 5 by the compressed air within the compressor chamber 6 may be borne by the thrust bearings 15A and 15B which grip the spherical ball 15C from both ends of the drive shaft 16D (rotary shaft 9) in the axial direction.

The air pressure from the pneumatic line 18 is preliminarily introduced into the compressor chamber 6 of the compressor body 1 so as to easily suppress generation of rattle of the ball coupling (anti-spinning mechanism 15) before starting the compression operation, thus further suppressing the unstable behavior of the orbiting scroll 5. During the compression operation after the start-up, the anti-spinning mechanism 15 allows smooth operation for preventing the spinning of the orbiting scroll 5, thus stabilizing the orbiting movement.

In the embodiment, the electric motor 16 is driven for a certain period until the pressure of the discharge port 8 of the compressor body 1 becomes equal to the pressure of the intake port 7 after opening the electromagnetic valve 19 at the intake side. The pressurized air flowing into the compressor chamber 6 from the pneumatic line 18 via the intake port 7 of the compressor body 1 is allowed to flow so as to be gradually infiltrated from the compressor chamber 6 at the outer diameter side to the one at the inner diameter side. The resultant air pressure is used to press the orbiting scroll 5 in the axial direction so as to be slowly orbited.

The orbiting scroll 5 is driven to orbit by the electric motor 16 for a certain period until the pressure of the discharge port 8 of the compressor body 1 becomes equal to the pressure of the intake port 7 to allow the orbiting scroll 5 to be smoothly driven to orbit, thus easily reducing the start-up load of the electric motor 16.

In this case, the pressure sensor 24 is disposed at the discharge port 8 of the compressor body 1, and the pressure sensor 23 is disposed at the intake port 7 between the pneumatic line 18 and the electromagnetic valve 19. In accordance with the pressure value (pressure $P_0$) detected by the pressure sensor 24 and the pressure value supplied from the pneumatic line 18 (pressure Pi detected by the pressure sensor 23), the timing (timing for starting the compression operation) for driving the electric motor 16 may be appropriately controlled.

In the embodiment, the compressor body 1 formed of the aforementioned scroll type compressor is used as the booster for boosting the pressure to appropriately reduce the operation sound during the compression operation, resulting in the noiseless state by reducing the abnormal or disturbing noise.

Figure 4:
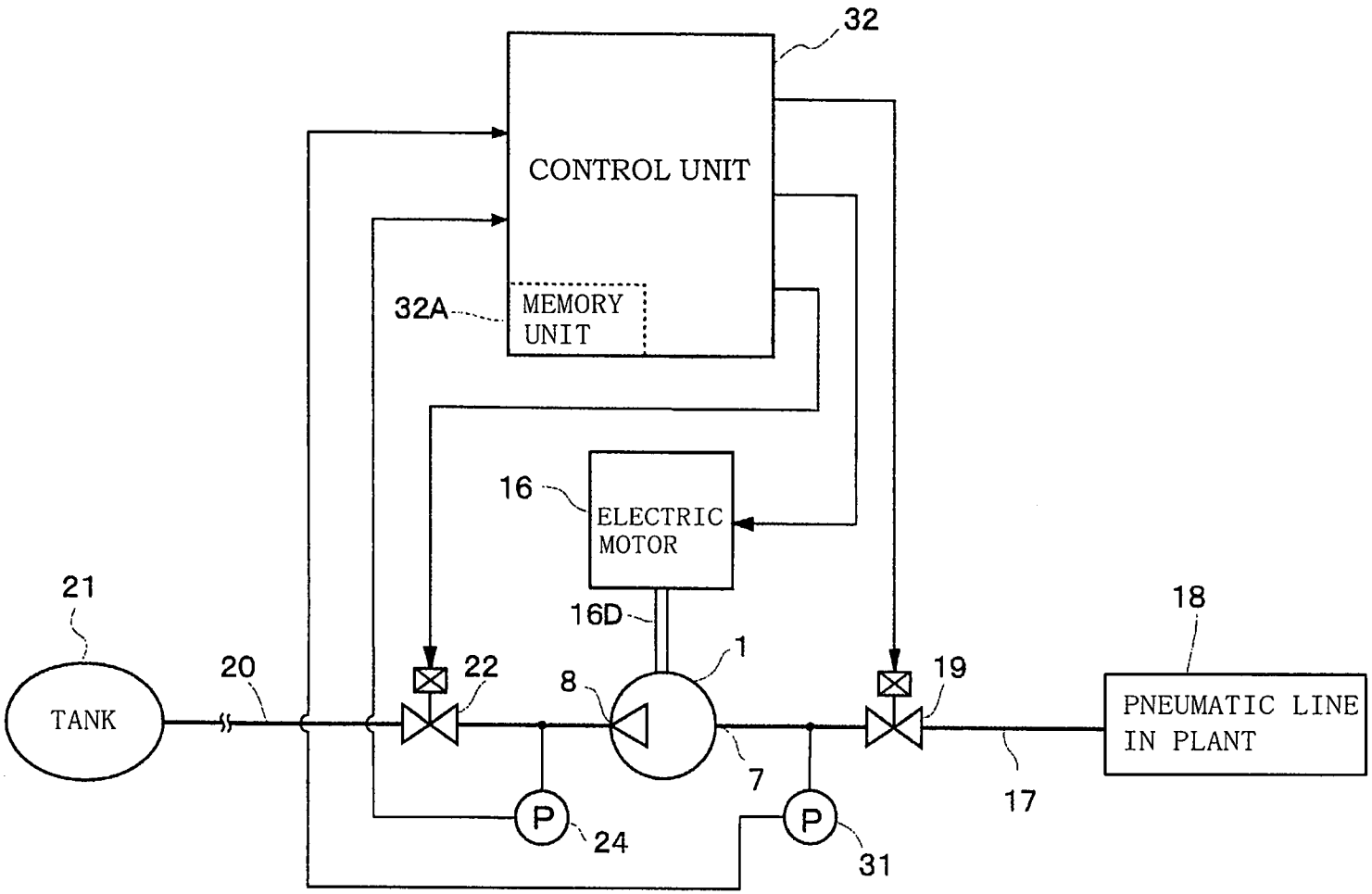
FIG. 4 is a view schematically showing the scroll type booster according to a second embodiment.
Figure 5:
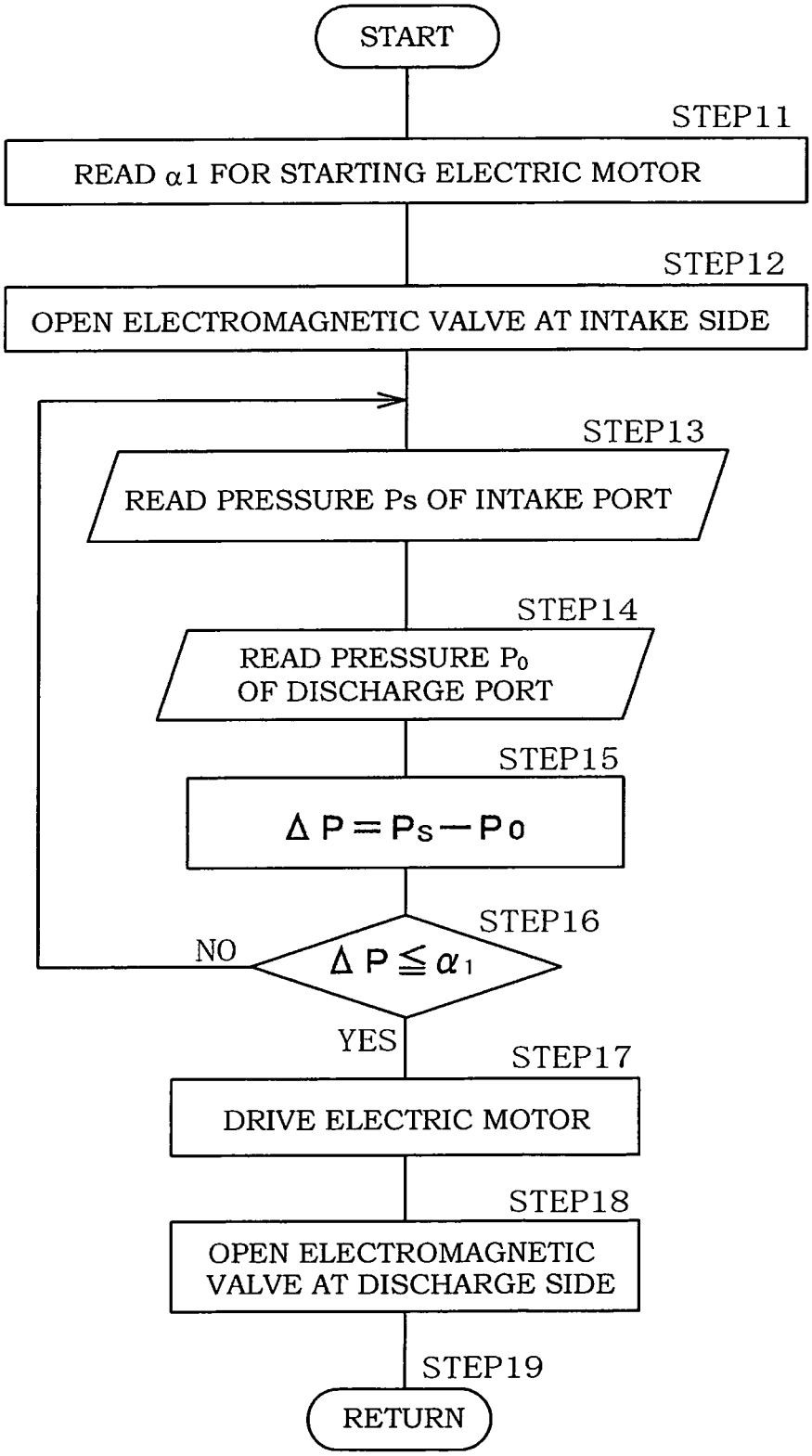
FIG. 5 is a flowchart showing the start-up control process performed by the control unit before the compression operation.

In a second embodiment shown in FIGS. 4 and 5, the pressure sensor at the intake side is disposed between the intake port of the compression unit and the on-off valve such that the pressure value detected by the pressure sensor is compared with the pressure value detected by the pressure sensor at the discharge side. In the embodiment, the same components as those of the first embodiment will be designated with the same reference numerals and the explanations thereof, thus will be omitted.

Referring to the drawings, a pressure sensor 31 for detecting the pressure at the intake side in the embodiment is disposed at the intermediate portion of the intake pipe 17 between the intake port 7 of the compressor body 1 and the electromagnetic valve 19 (on-off valve). The pressure sensor 31 detects the pressure Ps (see FIG. 5) generated at the intake port 7 upon opening of the electromagnetic valve 19 as the air pressure from the pneumatic line 18. The resultant detection signal is output to a control unit 32 to be described later.

The control unit 32 as the controller formed of the microcomputer has substantially the same structure as that of the control unit 25 as described in the first embodiment. The control unit 32 has the input side connected to the pressure sensors 24 and 31, and the output side connected to the electric motor 16, and the electromagnetic valves 19 and 22, respectively.

A memory unit 32A of the control unit 32 stores the processing program shown in FIG. 5 to be described later, and the reference pressure $\alpha 1$ (for example, the differential pressure $\alpha 1$ ranging from 0.01 to 0.1 MPa) as the reference value for starting the electric motor 16.

The control unit 32 executes the start-up control processing of the compressor body 1 shown in FIG. 5 according to the program shown in FIG. 5, and further executes the operation control of the compressor body 1. Accompanied with the aforementioned operations, the electromagnetic valves 19 and 22 are subjected to the on-off control, and the electric motor 16 is subjected to the driving and stopping control.

Referring to the flowchart shown in FIG. 5, upon starting of the processing, the reference pressure $\alpha 1$ (for example, the differential pressure $\alpha 1$ ranging from 0.01 to 0.1 MPa) as the reference value for starting the electric motor 16 is read from the memory unit 32A in step 11.

Then in step 12, the electromagnetic valve 19 at the intake side is opened to communicate the intake port 7 of the compressor body 1 with the pneumatic line 18 such that the air pressure (pressurized air) within the pneumatic line 18 is allowed to flow into the compressor chamber 6 from the intake port 7 of the compressor body 1 via the intake pipe 17.

In step 13, the pressure Ps of the intake port 7 is read from the pressure sensor 31 as the air pressure within the pneumatic line 18. Next in step 14, the pressure sensor 24 at the discharge side of the compressor body 1 reads the pressure $P_0$ of the discharge port 8. In step 15, the differential pressure $\Delta P$ between the pressure Ps of the intake port 7 and the pressure $P_0$ of the discharge port 8 is calculated using the following formula 2.

$$\Delta P = Ps - P_0 \qquad \text{Formula 2}$$

In step 16, it is determined whether or not the differential pressure ΔP calculated using the formula 2 is equal to or lower than the reference value α1 as the predetermined differential pressure value. The process returns to step 13 and subsequent steps are executed while NO is obtained. When YES is obtained in step 16, the differential pressure ΔP becomes equal to or lower than α1, and the pressure $P_0$ of the discharge port 8 is close to the pressure Ps of the intake port 7.

When YES is obtained in step 16, the process proceeds to step 17 where the power is supplied to the electric motor 16 to be driven so as to start driving the orbiting scroll 5 to orbit. In step 18, the electromagnetic valve 22 at the discharge side is opened. The process then returns to step 19 to continue the compression operation (steady operation).

In the above-structured embodiment, the electric motor 16 is driven after opening the electromagnetic valve 19 at the intake side to start driving the orbiting scroll 5 (compression operation) to orbit, thus providing substantially the same effects as those derived from the first embodiment.

In the embodiment, when the differential pressure ΔP between the pressure $P_0$ detected by the pressure sensor 24 at the discharge side and the pressure Ps detected by the pressure sensor 31 at the intake side after opening the electromagnetic valve 19 at the intake side becomes equal to or lower than the reference pressure α1 as the predetermined differential pressure value, the electric motor 16 is driven for a certain period until the pressure $P_0$ at the discharge side is close to and finally becomes the same as the pressure Ps at the intake side.

In accordance with the pressure Ps of the intake port 7 and the pressure $P_0$ of the discharge port 8, the timing for driving the electric motor 16 (timing for starting the compression operation) may be appropriately controlled. This makes it possible to smoothly drive the orbiting scroll 5 to orbit (start) in the state where the behavior of the orbiting scroll 5 is stabilized while preventing rattle or vibration of the orbiting scroll 5 by an amount equal to the axial gap (play) before starting the compression operation.

Figure 6:
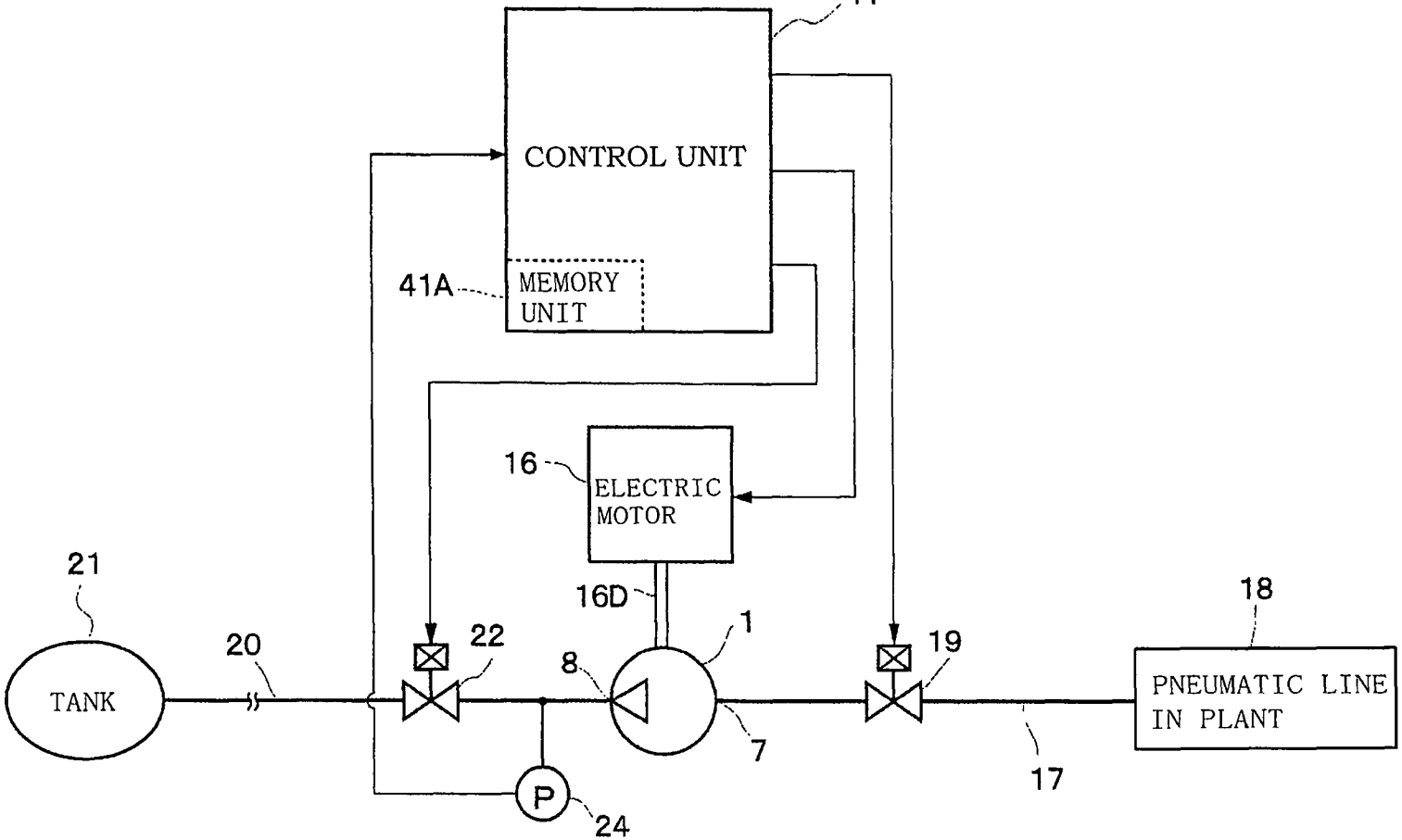
FIG. 6 is a view showing a scroll type booster according to a third embodiment.
Figure 7:
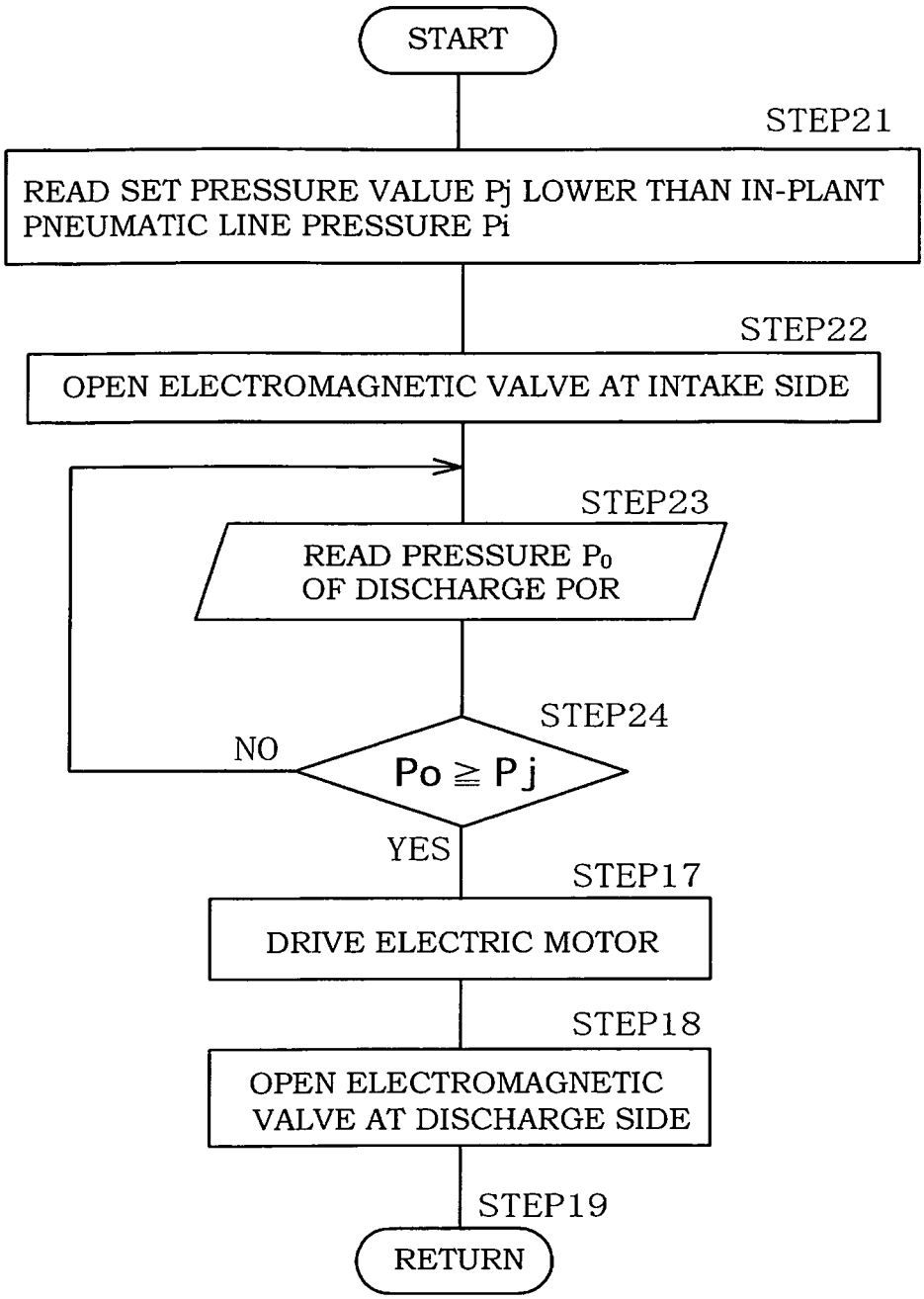
FIG. 7 is a flowchart showing the start-up control process performed by the control unit shown in FIG. 6 before the compression operation.

In a third embodiment of the present invention shown in FIGS. 6 and 7, the same components as those described in the first embodiment will be designated with the same reference numerals, and explanations thereof, thus will be omitted.

In the embodiment, the electric motor 16 is stopped until the pressure $P_0$ detected by the pressure sensor 24 at the discharge side reaches the preliminarily set pressure value Pj after opening the electromagnetic valve 19 at the intake side. When it exceeds the set pressure value Pj, the electric motor 16 is driven.

A control unit 41 as the controller employed in the embodiment has substantially the same structure as that of the control unit 25 as described in the first embodiment. However, unlike the first embodiment, the control unit 41 has its input side connected only to the pressure sensor 24 at the discharge side. A memory unit 41A of the control unit 41 stores the processing program as shown in FIG. 7 to be described later, and the set pressure value Pj (for example, Pj=0.1 to 0.4 MPa).

In this case, the set pressure value Pj is determined based on the set pressure at the pneumatic line 18, for example, it may be set to the pressure value lower than the pressure Pi of the pneumatic line 18 (see FIG. 3) as described in the first embodiment.

The control unit 41 executes the start-up control process of the compressor body 1 in accordance with the program shown in FIG. 7, and the operation control of the compressor body 1. The electromagnetic valves 19 and 22 are subjected to the on-off control, and the electric motor 16 is subjected to driving and stopping control in accordance with the above operation.

Upon start of the process in the flowchart of FIG. 7, the set pressure value Pj lower than the pressure Pi within the pneumatic line 18 (see FIG. 3) is read from the memory unit 41A in step 21.

In step 22, the electromagnetic valve 19 is opened to communicate the intake port 7 of the compressor body 1 with the pneumatic line 18. The air pressure (pressurized air) within the pneumatic line 18 is allowed to flow into the compressor chamber 6 from the intake port 7 of the compressor body 1 via the intake pipe 17.

In step 23, the pressure $P_0$ of the discharge port 8 is read by the pressure sensor 24 at the discharge side of the compressor body 1. Then in step 24, it is determined whether or not the pressure $P_0$ of the discharge port 8 has been boosted to reach the preliminarily set pressure value Pj.

While NO is obtained in step 24, the pressure $P_0$ of the discharge port 8 is equal to or lower than the set pressure value Pj, which is sufficiently lower than the pressure at the side of the pneumatic line 18. The process then returns to step 23 where the electric motor 16 is kept stopped, and the subsequent steps are executed. When YES is obtained in step 24, the pressure $P_0$ of the discharge port 8 exceeds the set pressure value Pj to be close to the pressure at the side of the pneumatic line 18.

When YES is obtained in step 24, the process proceeds to step 25 where power is supplied to the electric motor 16 to be driven so as to start driving the orbiting scroll 5 to orbit. In step 26, the electromagnetic valve 22 at the discharge side is opened, and in step 27, the process returns to continue the compressor operation (steady operation).

In the embodiment, the electric motor 16 is driven after opening the electromagnetic valve 19 at the intake side to start driving the orbiting scroll 5 to orbit (compression operation), thus providing substantially the same effects as those derived from the first embodiment.

In the embodiment, the timing for driving the electric motor 16 (timing for starting the compression operation) may be appropriately controlled based on the preliminarily set pressure value Pj and the pressure $P_0$ detected by the pressure sensor 24 at the discharge side. The use of the preliminarily set pressure value Pj eliminates the need for specially detecting the pressure at the intake side by the sensor, thus reducing the number of components and improving the work efficiency.

Figure 8:
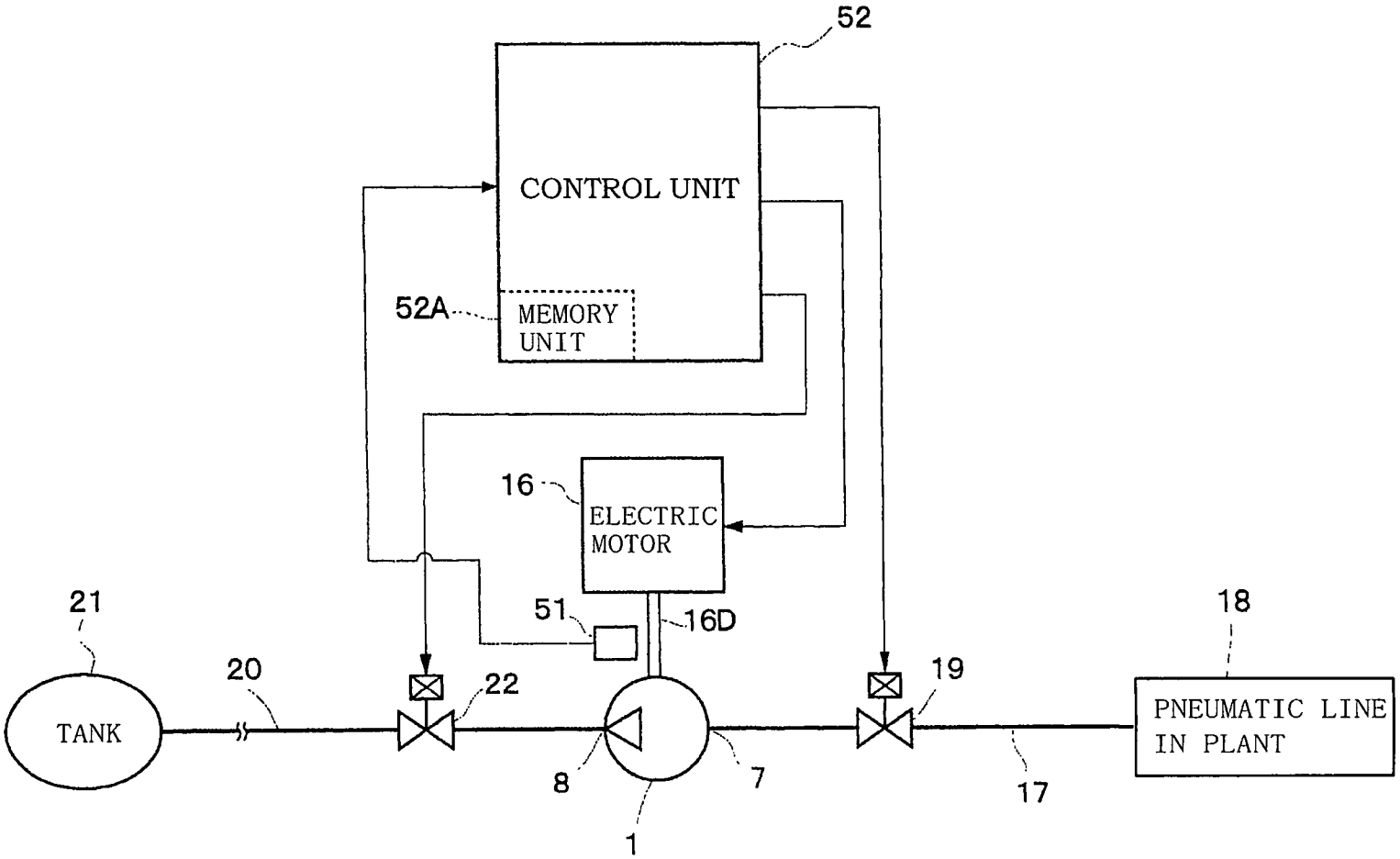
FIG. 8 is a view showing a scroll type booster according to a fourth embodiment.
Figure 9:
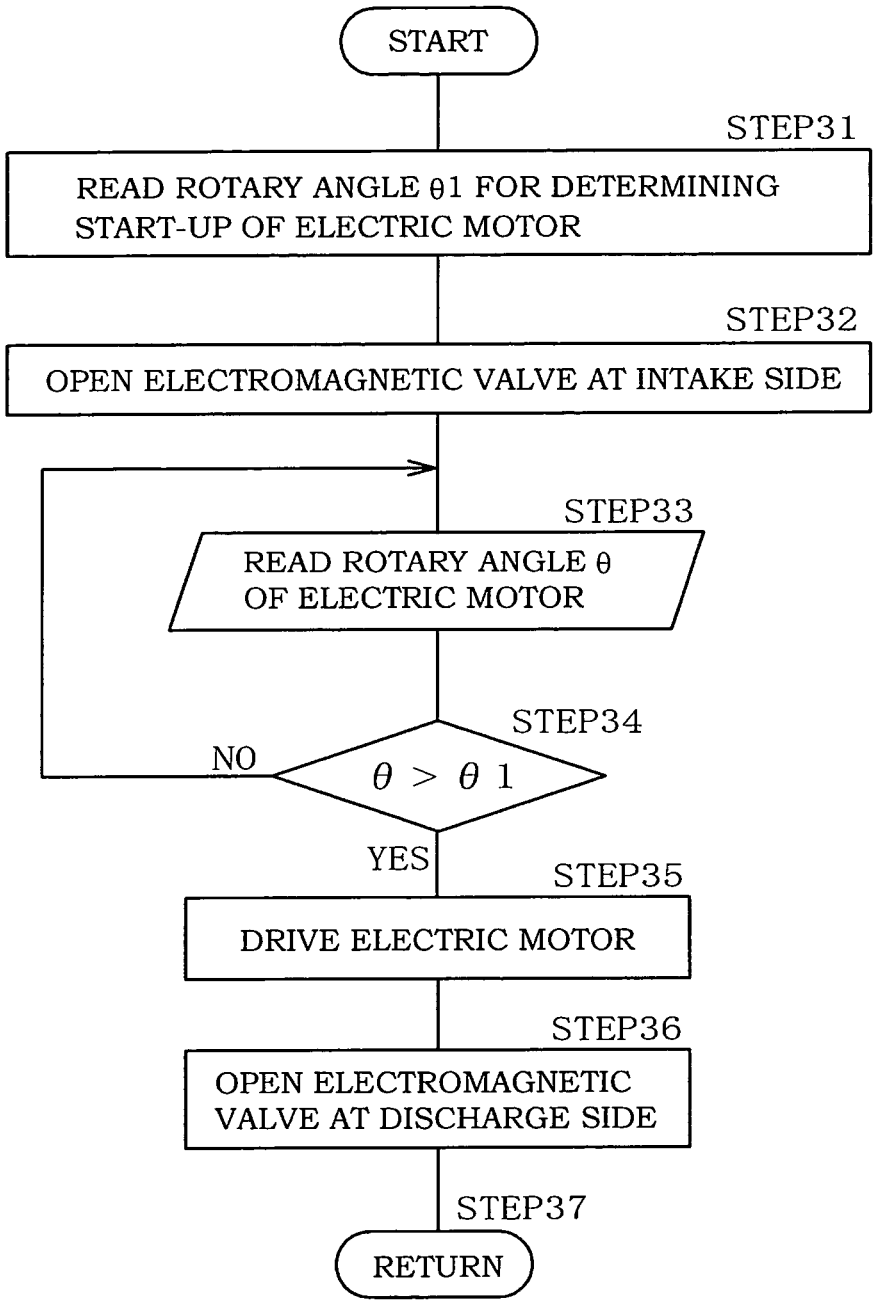
FIG. 9 is a flowchart showing the start-up control process performed by the control unit shown in FIG. 8 before the compression operation.

In a fourth embodiment shown in FIGS. 8 and 9, the same components as those of the first embodiment will be designated with the same reference numerals, and explanations thereof, thus will be omitted.

In the embodiment, a contact or a non-contact rotary sensor 51 for detecting the rotation position of the drive shaft 16D of the electric motor 16 is disposed therearound so as to appropriately control the timing for driving the electric motor 16 (timing for starting the compression operation) based on the rotation position of the drive shaft 16D.

A control unit 52 in the embodiment has substantially the same structure as that of the control unit 25 as described in the first embodiment. The control unit 52 has the input side connected to the rotary sensor 51, and the output side connected to the electric motor 16 and the electromagnetic valves 19 and 22. A memory unit 52A of the control unit 52 stores the processing program to be described later as shown in FIG. 9, and the predetermined rotary angle θ1 (for example, θ1=100° to 200°) for determining the timing for driving the electric motor 16.

The control unit 52 executes the start-up control process of the compressor body 1 according to the program shown in FIG. 9, and further the operation control of the compressor body 1. Then the electromagnetic valves 19 and 22 are subjected to the on-off control, and the electric motor 16 is subjected to the driving and stopping control accompanied with the above operations.

Upon starting of the process shown in the flowchart of FIG. 9, the rotary angle θ1 for determining the start-up of the electric motor 16 is read from the memory unit 52A in step 31. Then in step 32, the electromagnetic valve 19 at the intake side is opened to communicate the intake port 7 of the compressor body 1 with the pneumatic line 18. The air pressure (pressurized air) within the pneumatic line 18 is allowed to flow into the compressor chamber 6 from the intake port 7 of the compressor body 1 via the intake pipe 17.

Then in step 33, the rotary angle θ is read as the rotation position of the electric motor 16 (drive shaft 16D) by the rotary sensor 51. In step 34, it is determined whether or not the rotary angle θ of the drive shaft 16D exceeds the predetermined rotary angle θ1 as the predetermined reference value for making the determination.

While NO is obtained in step 34, the rotary angle θ of the drive shaft 16D is smaller than the rotary angle θ1, and the sufficient amount of pressurized air at the pneumatic line 18 has not been allowed to flow into the compressor chamber 6 of the compressor body 1 via the intake port 7. It may be determined that the drive shaft 16D of the electric motor 16 has not rotated to reach the rotation position corresponding to the reference rotary angle θ1.

While NO is obtained in step 34, the process returns to step 33 where the electric motor 16 is kept stopped, and the subsequent steps are executed. When YES is obtained in step 34, the rotary angle θ of the drive shaft 16D has reached the rotary angle θ1 as the reference value. So it may be determined that each pressure of the compressor chamber 6 of the compressor body 1 and the discharge port 8 is close to the pressure at the pneumatic line 18.

When YES is obtained in step 34, the process proceeds to step 35 where the power is supplied to the electric motor 16 to be driven to start driving the orbiting scroll 5 to orbit. Then in step 36, the electromagnetic valve 22 at the discharge side is opened, and the process returns to step 37 where the compression operation (steady operation) is continued.

In the above structured embodiment, the electric motor 16 is driven after opening the electromagnetic valve 19 at the intake side to start driving the orbiting scroll 5 to orbit (compression operation), thus providing substantially the same effects as those derived from the first embodiment.

In the embodiment, the rotary sensor 51 detects the rotary angle of the drive shaft 16D of the electric motor 16. So the timing for driving the electric motor 16 (timing for starting the compression operation) may be appropriately controlled based on the rotary angle θ of the drive shaft 16D detected by the rotary sensor 51 and the predetermined reference rotary angle θ1.

In this case, the use of the rotary sensor 51 eliminates the need for specially using the pressure sensor as described in the embodiment, thus reducing the number of components and improving the work efficiency of the assembly.

Figure 10:
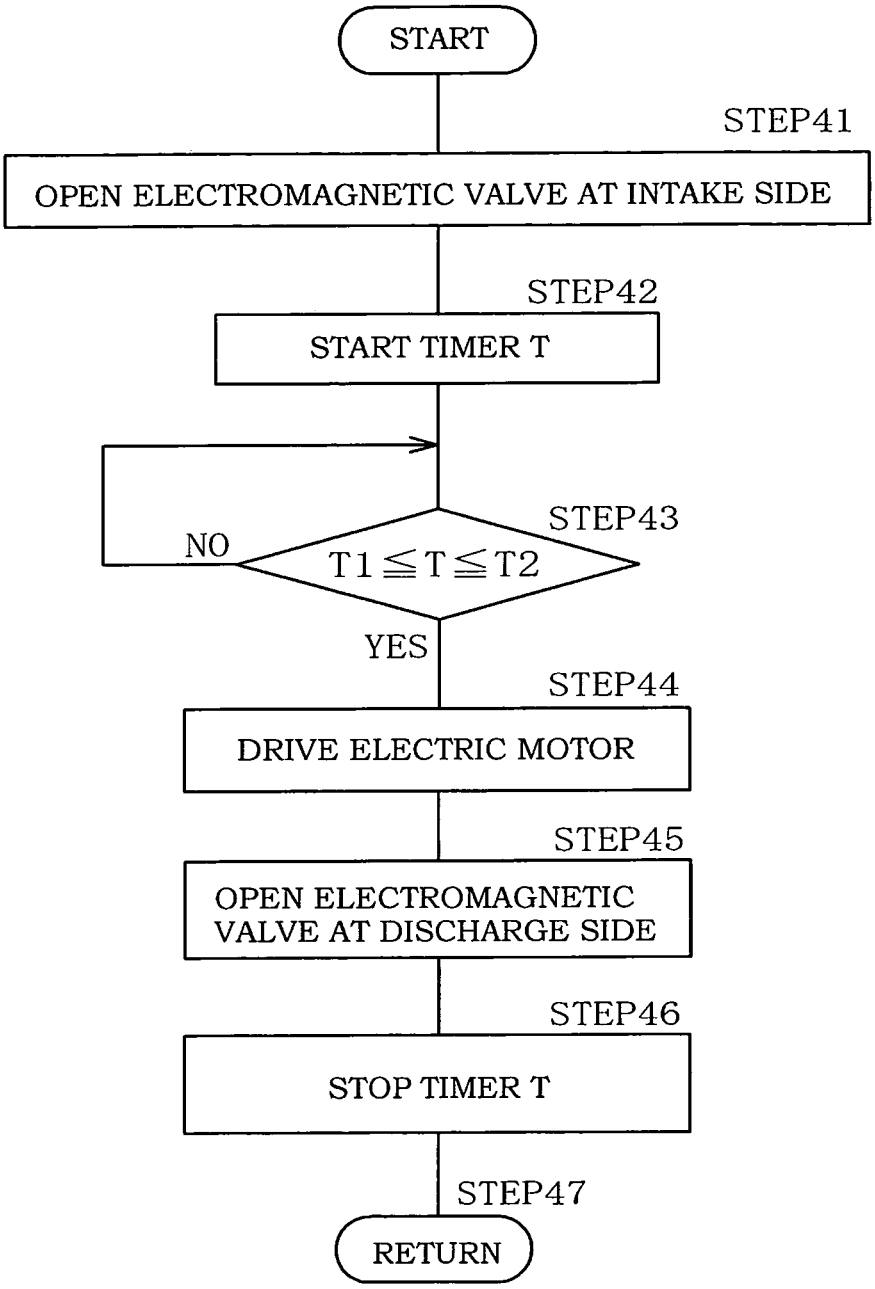
FIG. 10 is a flowchart showing the start-up control process before the compression operation according to a fifth embodiment.

In a fifth embodiment according to the present invention shown in FIG. 10, the same components as those described in the first embodiment will be designated with the same reference numerals, and explanations thereof, thus will be omitted. In the embodiment, the timing for driving the electric motor 16 is appropriately controlled based on the time elapsing from opening of the electromagnetic valve 19 at the intake side.

In the embodiment, a timer T is installed in the memory unit 25A of the control unit 25 shown in FIG. 1 so as to be updated. The timing for starting the drive of the electric motor 16 is controlled based on the elapsing time counted by the timer T.

Upon starting of the process shown in the flowchart of FIG. 10, the electromagnetic valve 19 at the intake side is opened in step 41 to communicate the intake port 7 of the compressor body 1 with the pneumatic line 18. The air pressure (pressurized air) within the pneumatic line 18 is allowed to flow into the compressor chamber 6 from the intake port 7 of the compressor body 1 via the intake pipe 17.

Then in step 42, the timer T is started to count the time elapsing from opening of the electromagnetic valve 19. In step 43, it is determined whether or not the time counted by the timer T is in a predetermined time range from T1 to T2.

The time range from T1 to T2 is determined based on the required time taken for the pressurized air within the pneumatic line 18 to flow into the compressor chamber 6 from the intake port 7 of the compressor body 1 via the intake pipe 17, and further to reach the discharge port 8, which is obtained in reference to the experimental data.

While NO is obtained in step 43, the time counted by the timer T has not reached the predetermined time T1, and accordingly, the pressurized air at the pneumatic line 18 has not sufficiently flown into the compressor chamber 6 of the compressor body 1 via the intake port 7.

When NO is obtained in step 43, the determination process in step 43 is repeatedly executed. When YES is obtained in step 43, the time counted by the timer T has reached the value in the predetermined time range from T1 to T2, that is, it may be determined that each pressure in the compressor chamber 6 of the compressor body 1 and the discharge port 8 is close to the pressure at the pneumatic line 18.

When YES is obtained in step 43, the process proceeds to step 44 where power is supplied to the electric motor 16 to be driven so as to start driving the orbiting scroll 5 to orbit. In step 45, the electromagnetic valve 22 at the discharge side is opened. In step 46, the timer T is stopped for resetting, and in step 47, the process returns to continue the compression operation (steady operation).

In the above structured embodiment, the electric motor 16 is driven after opening the electromagnetic valve 19 at the intake side so as to start driving the orbiting scroll 5 to orbit (compression operation), thus providing substantially the same effects as those derived from the first embodiment.

In the embodiment, the timer T which is generally used as the built-in element for the control unit 25 (see FIG. 1) is employed to appropriately control the timing for driving the electric motor 16 in accordance with the time elapsing from the opening of the electromagnetic valve 19 at the intake side. The timing for driving the electric motor 16 is determined based on the experimental data obtained so far to enable reduction in the start-up load when starting the compression operation.

Figure 11:
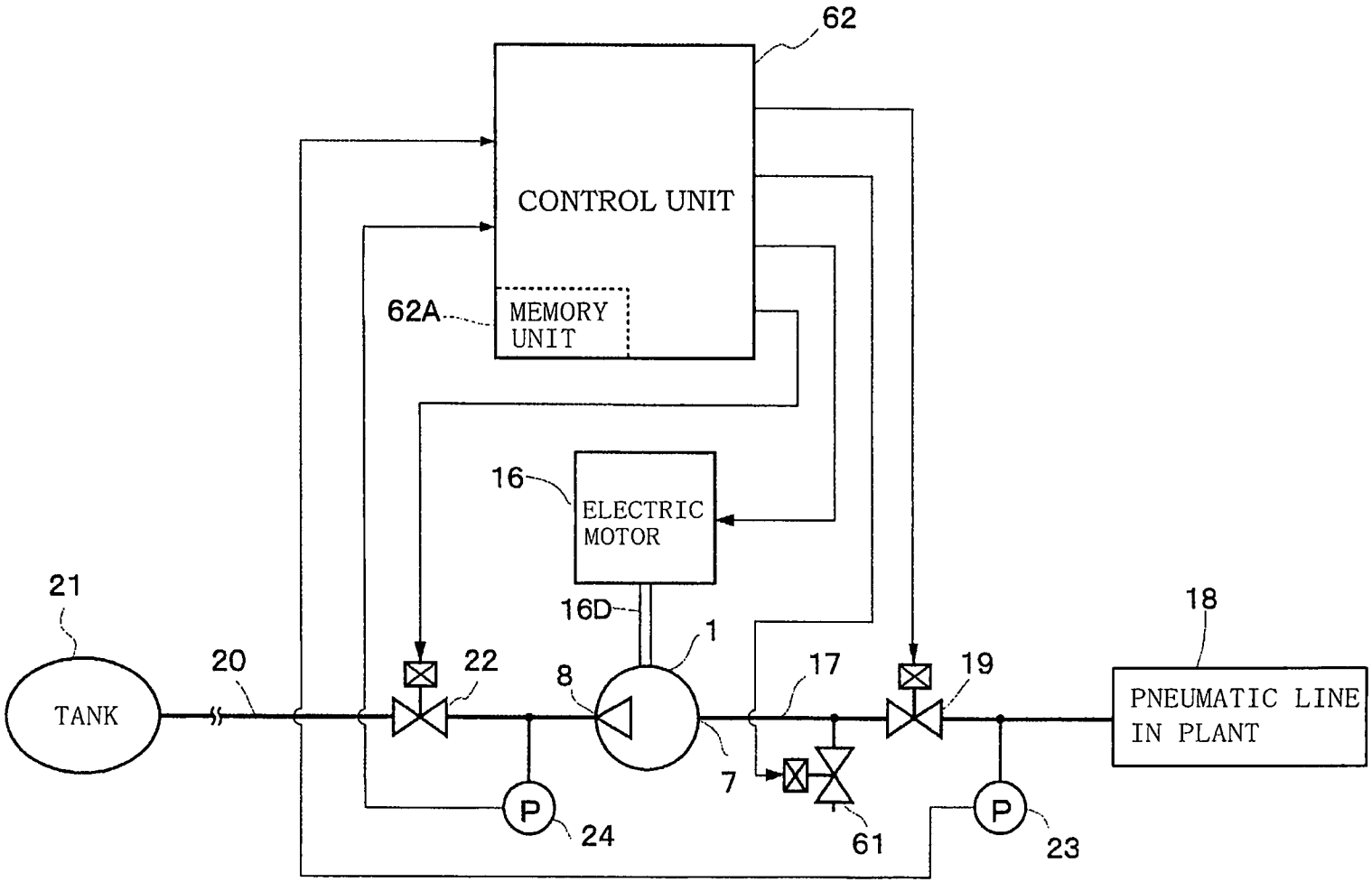
FIG. 11 is a view showing a scroll type booster according to a sixth embodiment.
Figure 12:
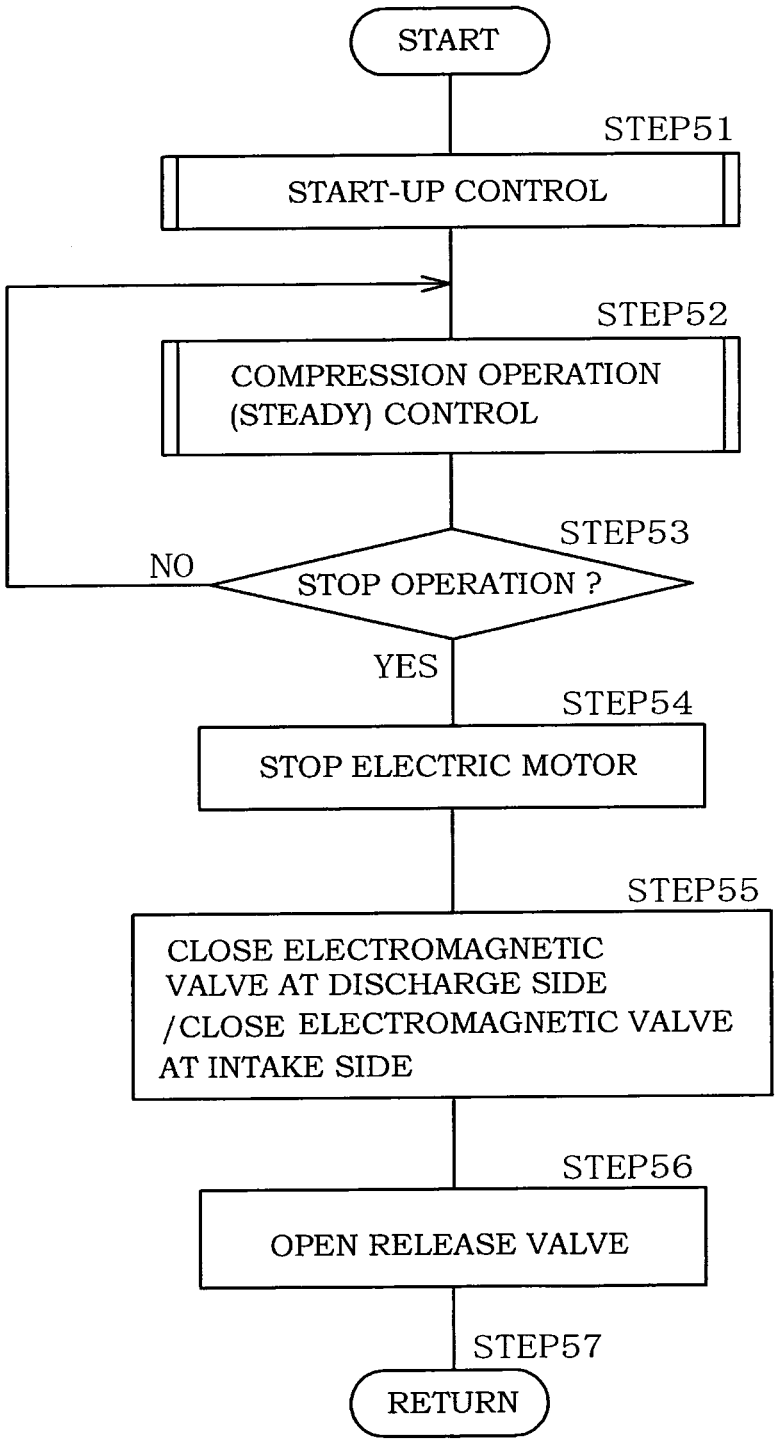
FIG. 12 is a flowchart showing the start-up control process performed by the control unit shown in FIG. 11 before the compression operation.

In a sixth embodiment shown in FIGS. 11 and 12, the same components as those described in the first embodiment will be designated with the same reference numerals, and explanations thereof, thus will be omitted. In the embodiment, a release valve 61 for opening the intake port 7 to the atmosphere in the state where the electromagnetic valve 19 at the intake side is closed is added between the intake port 7 of the compressor body 1 and the pneumatic line 18.

The release valve 61 is formed as the electromagnetic valve which is substantially the same as the electromagnetic valve 19 so as to be switched in accordance with a control signal from the controller (control unit 62). The control unit 62 in the embodiment has substantially the same structure as that of the control unit 25 as described in the first embodiment.

The control unit 62 has the input side connected to the pressure sensors 23 and 24, and the output side connected to the release valve 61 in addition to the electric motor 16 and the electromagnetic valves 19 and 22. A memory unit 62A of the control unit 62 stores the processing program shown in FIG. 12 to be described later.

The control unit 62 executes the start-up control process, the compression operation (steady state) control, and the stop control process of the compressor body 1 based on the program shown in FIG. 12 to be described later. Then the electromagnetic valves 19 and 22 are subjected to the on-off control, and the electric motor 16 is subjected to the driving and stopping control accompanied with the above operations.

That is, upon starting of the process as shown in the flowchart of FIG. 12, the start-up control is executed in step 51 in the same way as the process in steps 1 to 9 shown in FIG. 3 such that the orbiting scroll 5 of the compressor body 1 is smoothly started by the electric motor 16.

In step 52, the compression operation (steady state) is executed to keep driving the orbiting scroll 5 of the compressor body 1 to orbit by the electric motor 16. The high pressure compressed air is discharged into the tank 21 shown in FIG. 11. The operation control in the steady state of the compressor body 1 is executed such that the pressure in the tank 21 becomes the pressure value (not shown) in the predetermined range.

In step 53, it is determined whether or not the compression operation of the compressor body 1 is stopped. When NO is obtained, the pressure in the tank 21 has not reached the pressure value in the predetermined range. So the process returns to step 52 where the compression operation control is continuously executed.

When YES is obtained in step 53, the pressure in the tank 21 is within the predetermined range. The process proceeds to step 54 where the electric motor 16 is stopped (power supply is stopped) for executing the stop control process. In step 55, the electromagnetic valve 22 at the discharge side is closed to switch the electromagnetic valve 19 at the intake side into the close state. This may block the communication between the intake port 7 of the compressor body 1 and the pneumatic line 18 (intake pipe 17).

In step 56, the release valve 61 is opened to open the intake port 7 of the compressor body 1 to the atmosphere so as to release the compressed air which resides in the respective compressor chambers 6 to the atmosphere via the release valve 61 from the intake port 7. In this case, the release valve 61 is kept opened only for the predetermined period, and thereafter, it may be automatically closed. The process then returns to step 57.

In the above-structured embodiment, the start-up control is executed in step 51 as shown in FIG. 12 to start driving the orbiting scroll 5 to orbit (compression operation) by driving the electric motor 16 after opening the electromagnetic valve 19 at the intake side. This makes it possible to provide substantially the same effects as those derived from the first embodiment.

Especially in the embodiment, the release valve 61 for opening the intake port 7 to the atmosphere is disposed between the intake port 7 of the compressor body 1 and the pneumatic line 18 in the state where the electromagnetic valve 19 at the intake side is closed. Accordingly, the following effects may be obtained.

In the state where the compressed air resides in the respective compressor chambers 6 immediately after stopping the compression operation by the scroll type compressor body 1, the residual pressure in the compressor chamber 6 may be released to the atmosphere from the intake port 7 by stopping the electric motor 16 to close the electromagnetic valve 19 at the intake side (communication between the intake port 7 of the compressor body 1 and the pneumatic line 18 is blocked), thus suppressing generation of drain in the compressor chamber 6, for example.

Figure 13:
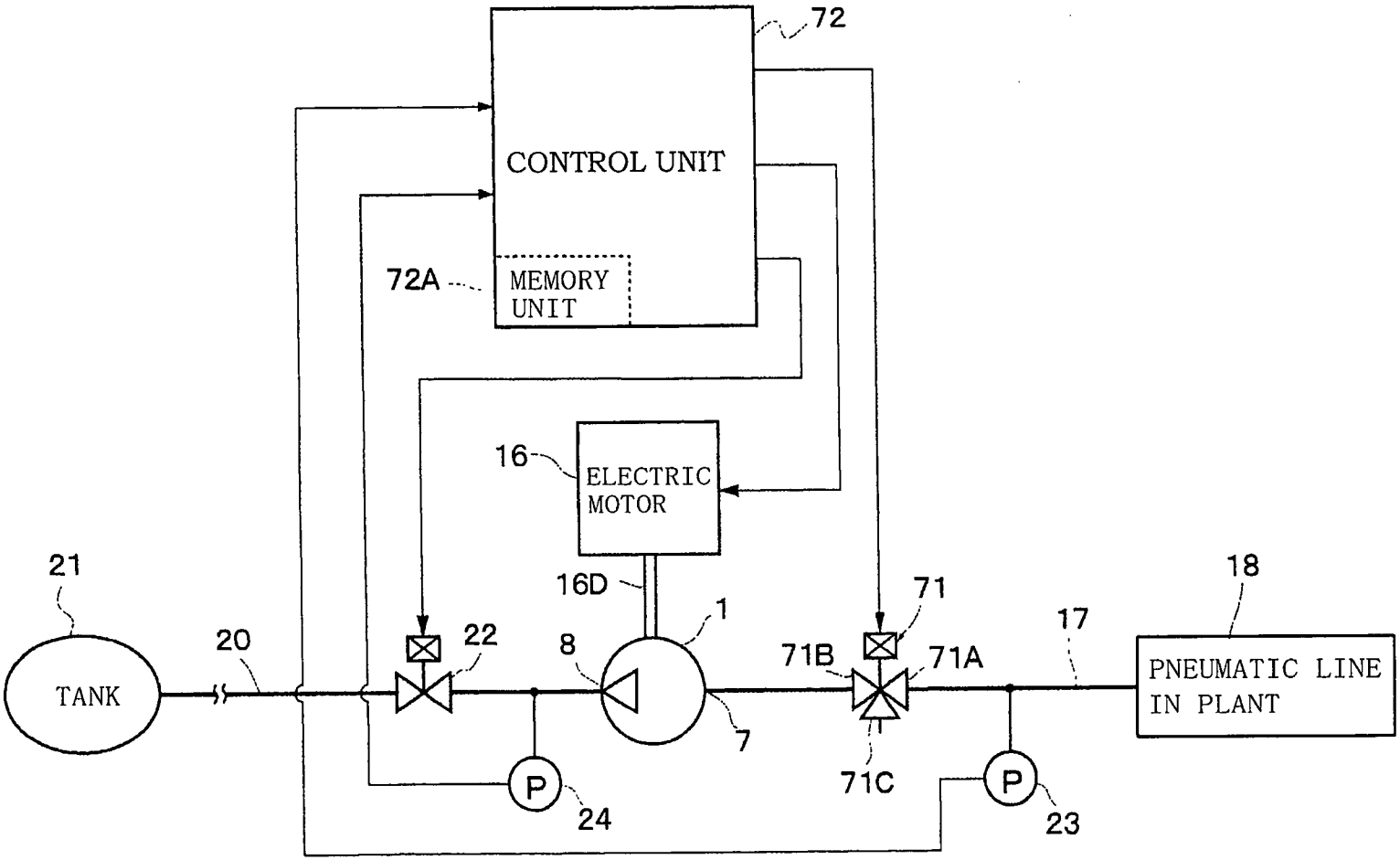
FIG. 13 is a view showing the scroll type booster according to a seventh embodiment.

In a seventh embodiment shown in FIG. 13, the same components as those described in the first embodiment are designated with the same reference numerals, and explanations thereof, thus will be omitted. In the embodiment, an electromagnetic three-way valve 71 is disposed at the intermediate portion at the intake pipe 17 between the intake port 7 of the compressor body 1 and the pneumatic line 18.

The three-way valve 71 may be used instead of the electromagnetic valve 19 (on-off valve) at the intake side and the release valve 61 as described in the sixth embodiment by covering functions of those valves. The three-way valve 71 includes three openings for inlet/outlet, that is, 71A, 71B and 71C, which may be switched there among (allowing/blocking communication) based on the control signal from a control unit 72.

With the three-way valve 71, when the openings 71A and 71B are communicated, the opening 71C is closed to the atmosphere. When communication between the openings 71A and 71B is blocked, the opening 71C is opened to the atmosphere such that the openings 71B and 71C are communicated.

The control unit 72 has substantially the same structure as that of the control unit 25 described in the first embodiment. The control unit 72 has the input side connected to the pressure sensors 23 and 24, and the output side connected to the electric motor 16, the electromagnetic valve 22 and the three-way valve 71. In this case, the control unit 72 executes substantially the same control process as the one executed by the control unit 62 described in the sixth embodiment.

The above-structured embodiment provides substantially the same effects as those derived from the sixth embodiment. In the state where the compressed air resides in the respective compressor chambers 6 immediately after stopping the scroll type compressor body 1, the residual pressure in the compressor chamber 6 may be released to the atmosphere from the intake port 7 by communicating the openings 71B and 71C when the electric motor 16 is stopped to close the opening 71A of the three-way valve 71 (communication between the intake port 7 of the compressor body 1 and the pneumatic line 18 is blocked), thus suppressing generation of the drain in the compressor chamber 6, for example.

In the embodiment, the single three-way valve 71 is used instead of the electromagnetic valve 19 at the intake side and the release valve 61 as described in the sixth embodiment for providing the same effects. As a result, the piping operation (joint work) of the three-way valve 71 may be efficiently performed in a short period.

In the sixth embodiment, the start-up control process in step 51 shown in FIG. 12 is executed in the same way as in steps 1 to 9 shown in FIG. 3. In the present invention, the same process as the start-up control process according to the second to the fifth embodiments shown in FIGS. 5, 7, 9 and 10 may also be performed, which may apply to the seventh embodiment.

In the respective embodiments, the electromagnetic valve 22 as the on-off valve at the discharge side is disposed at the discharge port 8 of the compressor body 1. However, the present invention is not limited to the aforementioned structure. The check valve for setting the valve opening pressure may be used instead of the electromagnetic valve 22. The check valve is opened when the pressure of the discharge port 8 increases to the predetermined pressure to allow the compressed fluid to flow from the discharge port 8 to the tank 21 such that the flow in the opposite direction is blocked.

In the embodiment, the anti-spinning mechanism 15, so-called ball coupling, is disposed between the casing 2 and the orbiting scroll 5 of the compressor body 1. However, the present invention is not limited to the aforementioned structure. For example, the anti-spinning mechanism formed of the auxiliary crank or Oldham's coupling may be employed.

In the respective embodiments, the anti-spinning mechanism 15 formed of the ball coupling is employed to serve as the thrust support mechanism. However, the present invention is not limited to the aforementioned structure. For example, the thrust support mechanism may be formed as the member separated from the anti-spinning mechanism.

Meanwhile, in the fourth embodiment, the rotary sensor 51 is disposed around the drive shaft 16D of the electric motor 16 for detecting the rotation position of the drive shaft 16D. However, the present invention is not limited to the aforementioned structure. For example, when the rotary position detection function is built in the electric motor, such function may be employed as the rotary sensor. The rotation position of not only the drive shaft 16D but also the rotary shaft 9 shown in FIG. 2 may be detected.

The respective embodiments describe the scroll type booster (air compressor of scroll type) connected to the pneumatic line 18 in the plant for boosting the pressurized air. The present invention is not limited to the aforementioned structure. For example, it may be applied to the high pressure side of the multi-stage compressor. Wide variety of fluid may be used as the fluid to be boosted, for example, the nitrogen gas, helium gas and the like.

The respective embodiments describe the use of the compressor body 1 of scroll type provided with the fixed scroll 3 and the orbiting scroll 5. However, the present invention is not limited to the aforementioned structure. For example, various types of scroll compressor may be employed as the compression unit, for example, the scroll type compressor of the whole rotary type having two opposite scroll members allowed to rotate.

What is claimed is:

1. A scroll type booster comprising:

a scroll type compression unit which sucks a pressurized fluid supplied from an external pressurized fluid supply unit through an intake port, compresses the pressurized fluid in a compressor chamber, and discharges a compressed fluid from a discharge port during an orbiting movement with wrap portions of two scroll members overlapped;

a drive unit for driving at least one of the scroll members which form the compression unit for the orbiting movement;

an on-off valve disposed between the intake port of the compression unit and the pressurized fluid supply unit for allowing and blocking a communication between the intake port and the pressurized fluid supply unit;

a discharge pressure sensor disposed at a discharge side of the compression unit;

an intake pressure sensor disposed at an intake side of the compression unit; and a control unit for controlling opening and closing of the on-off valve, and driving and stopping of the drive unit, wherein the control unit allows the drive unit to start driving said at least one of the scroll members for the orbiting movement when a difference between a pressure detected by the discharge pressure sensor and a pressure detected by the intake pressure sensor becomes no more than a predetermined differential pressure after opening the on-off valve to allow the external pressurized fluid supply unit to communicate with the intake port, so that the pressurized fluid is supplied from the external pressurized fluid supply unit to the intake port to increase the pressure detected by the intake pressure sensor and to press the one of the two scroll members in the axial direction to decrease a gap formed between the two scroll members.

2. The scroll type booster according to claim 1, wherein:

the compression unit includes an anti-spinning mechanism for suppressing a spinning of the scroll member to be driven for the orbiting movement; and the anti-spinning mechanism is formed of a ball coupling which includes a rigid spherical ball, and a pair of thrust bearings which grip the ball from both sides of the scroll member in a thrust direction to bear a thrust load exerted on said at least one of the scroll members.

3. The scroll type booster according to claim 1, wherein the control unit is structured to start driving the drive unit in a period after opening the on-off valve and before a pressure of the discharge port of the compression unit becomes equal to a pressure of the intake port.

4. The scroll type booster according to claim 2, wherein the control unit is structured to start driving the drive unit in a period after opening the on-off valve and before a pressure of the discharge port of the compression unit becomes equal to a pressure of the intake port.

5. The scroll type booster according to claim 1, wherein: the control unit is structured to keep the drive unit stopped until a pressure value detected by the pressure sensor at the discharge side reaches a preliminarily set pressure value, and to drive the drive unit when the pressure value exceeds the preliminarily set pressure value.

6. The scroll type booster according to claim 1, wherein: the control unit is structured to keep the drive unit stopped until a pressure value detected by the pressure sensor at the discharge side reaches a preliminarily set pressure value, and to drive the drive unit when the pressure value exceeds the preliminarily set pressure value.

7. The scroll type booster according to claim 1, wherein: the control unit is structured to keep the drive unit stopped until a pressure value detected by the pressure sensor at the discharge side reaches a preliminarily set pressure value, and to drive the drive unit when the pressure value exceeds the preliminarily set pressure value.

8. The scroll type booster according to claim 1, wherein the control unit is structured to drive the drive unit in a predetermined time range after opening the on-off valve.

9. The scroll type booster according to claim 2, wherein the control unit is structured to drive the drive unit in a predetermined time range after opening the on-off valve.

10. The scroll type booster according to claim 1, wherein:

a release valve is disposed between the intake port of the compression unit and the pressurized fluid supply unit for opening the intake port to atmosphere while the on-off valve is closed; and the control unit is structured to stop an operation of the drive unit to open the release valve while the on-off valve is closed.

11. The scroll type booster according to claim 2, wherein:

a release valve is disposed between the intake port of the compression unit and the pressurized fluid supply unit for opening the intake port to atmosphere while the on-off valve is closed; and the control unit is structured to stop an operation of the drive unit to open the release valve while the on-off valve is closed.

12. The scroll type booster according to claim 3, wherein:

a release valve is disposed between the intake port of the compression unit and the pressurized fluid supply unit for opening the intake port to atmosphere while the on-off valve is closed; and the control unit is structured to stop an operation of the drive unit to open the release valve while the on-off valve is closed.

13. A scroll type booster comprising:

a scroll type compression unit which sucks a pressurized fluid supplied from an external pressurized fluid supply unit through an intake port, compresses the pressurized fluid in a compressor chamber, and discharges a compressed fluid from a discharge port during an orbiting movement with wrap portions of two scroll members overlapped;

a drive unit for driving at least one of the scroll members which form the compression unit for the orbiting movement;

an on-off valve disposed between the intake port of the compression unit and the pressurized fluid supply unit, for allowing communication between the intake port and the pressurized fluid supply unit in an open state of said on-off valve, and blocking such communication in a closed state;

a discharge pressure sensor disposed at a discharge side of the compression unit;

an intake pressure sensor disposed at an intake side of the compression unit; and a control unit for controlling opening and closing of the on-off valve, and driving and stopping of the drive unit;

wherein, when a difference between a pressure detected by the discharge pressure sensor and a pressure detected by the intake pressure sensor becomes no more than a predetermined differential pressure after the control unit causes said on-off valve to open, allowing the external pressurized fluid supply unit to supply pressurized fluid to the intake port so that the pressure detected by the intake pressure sensor is increased to press the one of the two scroll members in the axial direction to decrease a gap formed between the two scroll members, the control unit allows said drive unit to start driving said at least one of the scroll members for the orbiting movement.

* * * * *